US010086499B2

(12) United States Patent
Mejean et al.

(10) Patent No.: US 10,086,499 B2
(45) Date of Patent: Oct. 2, 2018

(54) ABRASIVE ARTICLE AND METHOD OF USE

(71) Applicants: SAINT-GOBAIN ABRASIVES, INC., Worcester, MA (US); SAINT-GOBAIN ABRASIFS, Conflans-Sainte-Honorine (FR)

(72) Inventors: Cecile O. Mejean, Acton, MA (US); Srinivasan Ramanath, Holden, MA (US); Ramanujam Vedantham, Shrewsbury, MA (US); Kelley McNeal, Northborough, MA (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 125 days.

(21) Appl. No.: 15/060,939

(22) Filed: Mar. 4, 2016

(65) Prior Publication Data

US 2016/0256982 A1 Sep. 8, 2016

Related U.S. Application Data

(60) Provisional application No. 62/128,454, filed on Mar. 4, 2015.

(51) Int. Cl.
*B24D 7/06* (2006.01)

(52) U.S. Cl.
CPC ..... *B24D 7/06* (2013.01)

(58) Field of Classification Search
CPC . B24D 7/06; B24D 7/16; B24D 7/066; B24D 7/04; B24D 7/02
USPC ..... 451/548
See application file for complete search history.

(56) References Cited

U.S. PATENT DOCUMENTS

| | | | | | |
|---|---|---|---|---|---|
| 794,495 | A | * | 7/1905 | Gorton | B24D 11/00 451/529 |
| 1,105,089 | A | * | 7/1914 | McGovern | B24D 7/02 451/551 |
| 1,651,217 | A | * | 11/1927 | Milne | B24D 7/02 451/353 |
| 1,733,723 | A | * | 10/1929 | Doermann | B24D 7/16 451/548 |
| RE17,853 | E | * | 11/1930 | McGovern | B24D 7/02 451/551 |

(Continued)

FOREIGN PATENT DOCUMENTS

| | | |
|---|---|---|
| JP | S50140086 U | 11/1975 |
| JP | S63134174 A | 6/1988 |

(Continued)

OTHER PUBLICATIONS

International Search Report and Written Opinion for PCT Application No. PCT/US2016/020849, dated Jun. 29, 2016, 13 pages.

*Primary Examiner* — George Nguyen
(74) *Attorney, Agent, or Firm* — Abel Law Group, LLP; Joseph P. Sullivan

(57) ABSTRACT

An abrasive article includes a body having an annular surface including abrasive segments coupled to the annular surface, and the abrasive segments define an abrasive annular region and a percent abrasive surface area of not greater than 24% for the total surface area of the abrasive annular region.

19 Claims, 7 Drawing Sheets

(56) References Cited

U.S. PATENT DOCUMENTS 2,019,205 A * 10/1935 Waldron ..... B24B 7/24 451/551
2,039,578 A * 5/1936 Blount ..... B24D 7/02 241/296
2,088,392 A * 7/1937 Waldron ..... B24B 7/24 451/551
2,088,393 A * 7/1937 Waldron ..... B24B 7/24 451/551
2,225,193 A * 12/1940 Benner ..... B24D 5/06 16/42 R
2,451,295 A * 10/1948 Metzger ..... B24D 7/14 451/461
2,867,063 A * 1/1959 Metzger ..... B24D 7/06 451/548
3,318,053 A * 5/1967 Miller ..... B24D 7/06 451/548
3,495,362 A * 2/1970 Hillenbrand ..... B24D 7/02 451/527
3,553,906 A * 1/1971 Hinshaw ..... B24D 7/06 541/548
3,745,719 A * 7/1973 Oswald ..... B24D 7/066 451/548
4,224,768 A * 9/1980 Denney ..... B24B 19/02 451/548
5,076,024 A * 12/1991 Akagawa ..... B24B 37/12 451/449
5,247,765 A * 9/1993 Quintana ..... B24D 7/063 451/548
5,782,682 A * 7/1998 Han ..... B24B 7/22 451/527
5,911,620 A 6/1999 Spangenberg et al.
5,997,382 A * 12/1999 Sasamori ..... B24B 1/00 451/28
6,299,522 B1 * 10/2001 Lee ..... B24B 55/102 451/488
6,726,550 B2 * 4/2004 Nishihara ..... B24B 37/26 451/285
6,949,012 B2 * 9/2005 Barnett, III ..... B24B 53/017 451/548
8,568,206 B2 10/2013 Ramanath et al.
2001/0011004 A1 * 8/2001 Yamaguchi ..... B24B 7/228 451/548
2003/0003858 A1 1/2003 Hirata et al.
2003/0054746 A1 * 3/2003 Nussbaumer ..... B24D 7/06 451/548
2003/0139128 A1 * 7/2003 Spangenberg ..... B24B 55/102 451/548
2006/0079160 A1 4/2006 Balagani et al.
2013/0040542 A1 2/2013 Schwappach et al.
2013/0260656 A1 10/2013 Seth et al.
2014/0187130 A1 * 7/2014 Gosamo ..... B24D 7/066 451/542
2016/0256982 A1 * 9/2016 Mejean ..... B24D 7/06

FOREIGN PATENT DOCUMENTS

JP H10264042 A 10/1998
JP 2000288882 A 10/2000
JP 2001157967 A 6/2001
JP 2005161449 A 6/2005
JP D1251372 S 9/2005
JP D1252015 S 9/2005
JP 2010036303 A 2/2010
JP 2011251380 A 12/2011
TW 508287 B 11/2002
TW M294991 U 8/2006
TW 200821093 A 5/2008
WO 2014105638 A1 7/2014

* cited by examiner

ABRASIVE ARTICLE AND METHOD OF USE

CROSS-REFERENCE TO RELATED APPLICATION(S)

The present application claims priority from U.S. Provisional Patent Application No. 62/128,454, filed Mar. 4, 2015, entitled "Abrasive Article and Method of Use," naming inventors Cecile O. Mejean, Srinivasan Ramanath and Ramanujam Vedantham, which application is incorporated by reference herein in its entirety.

BACKGROUND

Field of the Disclosure

The following is directed to an abrasive article, and particularly, an abrasive article including bonded abrasive segments.

Description of the Related Art

A variety of abrasive tools have been developed over the past century for various industries for the general function of removing material from a workpiece, including for example, sawing, drilling, polishing, cleaning, carving, and grinding. In the production of electronic devices, the back surface of a semiconductor wafer having a plurality of circuits such as IC's and LSI's is ground to a predetermined thickness by a grinding machine before it is divided into individual chips. To grind the back surface of the semiconductor wafer efficiently, a grinding machine equipped with a rough grinding unit and a finish grinding unit is generally used. Generally, the article utilize to conduct the rough grinding process is a bonded abrasive body or grindstone, which is obtained by bonding together abrasive grains with a vitrified bond or metal bond material. A resin bond grindstone is typically used for finish grinding operations.

In some cases, the content of the inorganic bonding agent is reduced and the content of porosity is increased, which is considered to reduce glazing or clogging of the surface of the vitrified grindstone, chipping of the abrasive structure, poor dressability of the grindstone, and other drawbacks. Generally, high-porosity grindstone bodies are accomplished by the use of foaming agents during forming, which create bubbles and thus porosity in the finally-formed abrasive product.

Still, the industry continues to demand improved grindstone materials, capable of achieving improved grinding performance.

SUMMARY

According to one aspect, an abrasive article includes a body having an annular surface including abrasive segments coupled to the annular surface, wherein the abrasive segments define an abrasive annular region and a percent abrasive surface area of not greater than 24% for the total surface area of the abrasive annular region.

In yet another aspect, an abrasive article includes a body has an annular surface including abrasive segments coupled to the annular surface, wherein the abrasive segments define an abrasive annular region having an inner annular region, an outer annular region, and a central annular region disposed between the inner annular region and the outer annular region, and wherein at least one abrasive segment in the inner annular region or outer annular region has a different abrasive surface area compared to an abrasive segment in the central annular region.

For still another aspect, an abrasive article includes a body having an annular surface including a first abrasive segment coupled to the annular surface having a first abrasive surface area (ASA1) and a second abrasive segment coupled to the annular surface having a second abrasive surface area (ASA2), wherein ASA1>ASA2.

For one aspect herein, an abrasive article includes a body having an annular surface including abrasive segments coupled to the annular surface, wherein the abrasive segments define an abrasive annular region having an inner annular region, an outer annular region, and a central annular region disposed between the inner annular region and the outer annular region, and wherein the inner annular region comprises a first group of abrasive segments defining a first distribution and the central region comprises a second group of abrasive segments defining a second distribution, wherein the first distribution is different than the second distribution.

For yet another aspect, an abrasive article includes a body having an annular surface including abrasive segments coupled to the annular surface, wherein the abrasive segments define an abrasive annular region having an annular width defined as a distance between an inner annular circumference and an outer annular circumference along a radial axis, and wherein at least one abrasive segment extends for not greater than 95% of the annular width.

According to still another aspect, an abrasive article may include a body having an annular surface that may include abrasive segments coupled to the annular surface. The abrasive segments may define an abrasive annular region having an inner annular region, an outer annular region, and a central annular region disposed between the inner annular region and the outer annular region. At least one abrasive segment may span the inner annular region, the central annular region and the outer annular region. A first end portion of the at least one abrasive segment in the inner annular region or the outer annular region may be distinct from a central portion of the at least one abrasive segment in the central annular region. An angle between a longitudinal axis of the first end portion and a longitudinal axis of the central portion may be less than 180 degrees.

According to one aspect, an abrasive article includes a body having an annular surface including abrasive segments including abrasive particles contained within a bond material, the abrasive segments coupled to the annular surface of the body and are arranged relative to each other to define a normalized maximum contact area variation (NMCAV) of not greater than 0.150 according to a contact area test.

BRIEF DESCRIPTION OF THE DRAWINGS

The present disclosure may be better understood, and its numerous features and advantages made apparent to those skilled in the art by referencing the accompanying drawings.

DETAILED DESCRIPTION

The following is directed toward abrasive articles, and more particularly, abrasive articles that include one or more bonded abrasive articles, which may be in the form of segments. The abrasive segments can be bonded abrasive articles including a plurality of abrasive particles contained within a three dimensional matrix of bond material. The bonded abrasive article may be suitable for grinding a workpiece and material removal operations. In certain instances, the bonded abrasive article may be particularly suited for grinding of hard materials, and more particularly, hard, single crystalline materials, such a sapphire wafers.

The abrasive articles of the embodiments herein may be utilized in certain material removal operations. For example the abrasive article can be utilized in a material removal operation where the process includes removing material from a plurality of wafers simultaneously by moving the abrasive article relative to the plurality of wafers. In certain instances, the process of moving the abrasive article relative to the plurality of wafers can include rotating the abrasive article relative to the plurality of wafers, which may be held in a stationary position. In other instances, the process of moving the abrasive article relative to the plurality wafers can include rotating the plurality of wafers relative to the abrasive article, which may be held in a stationary position. It will be appreciated in such processes the relative movement between the abrasive article can include can include movement of the abrasive article and/or plurality of wafers relative to each other.

Figure 1:
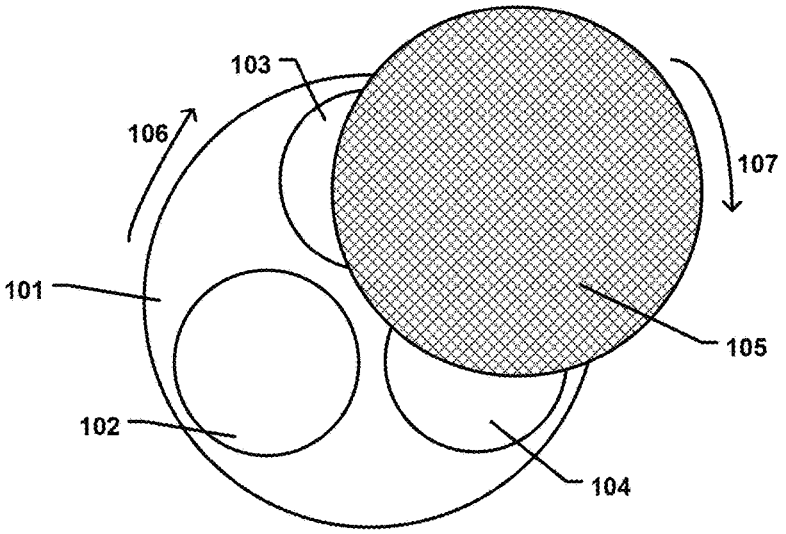
FIG. 1 includes an illustration of a multi-wafer grinding operation according to an embodiment.

FIG. 1 includes an illustration of a multi-wafer material removal process using an abrasive article according to an embodiment. In particular, the multi-wafer material removal process includes a chuck 101 including a plurality of wafers 102, 103, and 104 (i.e., 102-104) coupled thereto. As further illustrated, the process can include an abrasive article 105 having the features of the embodiments herein. During the material removal process, the abrasive article 105 can be in contact with one or more surfaces of the plurality of wafers 102-104 and removing material from the surfaces of the plurality of wafers 102-104. As illustrated, the chuck 101 and the abrasive article 105 can be rotated relative to each other in the directions 106 and 107, respectively. The directions of rotation 106 and 107 in FIG. 1 are provided for illustration, and it will be appreciated that other relative rotations between the chuck 101 and abrasive article 105 may be utilized.

Furthermore, as illustrated in FIG. 1, during the material removal operation, the abrasive article 105 can be in contact with at least a surface of a single wafer of the plurality of wafers 102-104. More particularly, during the material removal process, as the abrasive article 105 rotates over the chuck 101 and the plurality of wafers 102-104, the force per grit on the abrasive article 105 can vary with varying surface area contact between the abrasive article 105 and the surfaces of the plurality of wafers 102-104. Unlike single wafer grinding operations, the variation in the contact area between the bonded abrasive material (e.g., bonded abrasive segments) and the wafers 102-104 during multi-wafer grinding operations has been identified by the Applicants as the cause for some unsatisfactory results, including damage to the wafers 102-104. As the industry continues to migrate to multi-wafer grinding operations, the demand for products that can avoid unnecessarily damaging the products increases rapidly.

Figure 2:
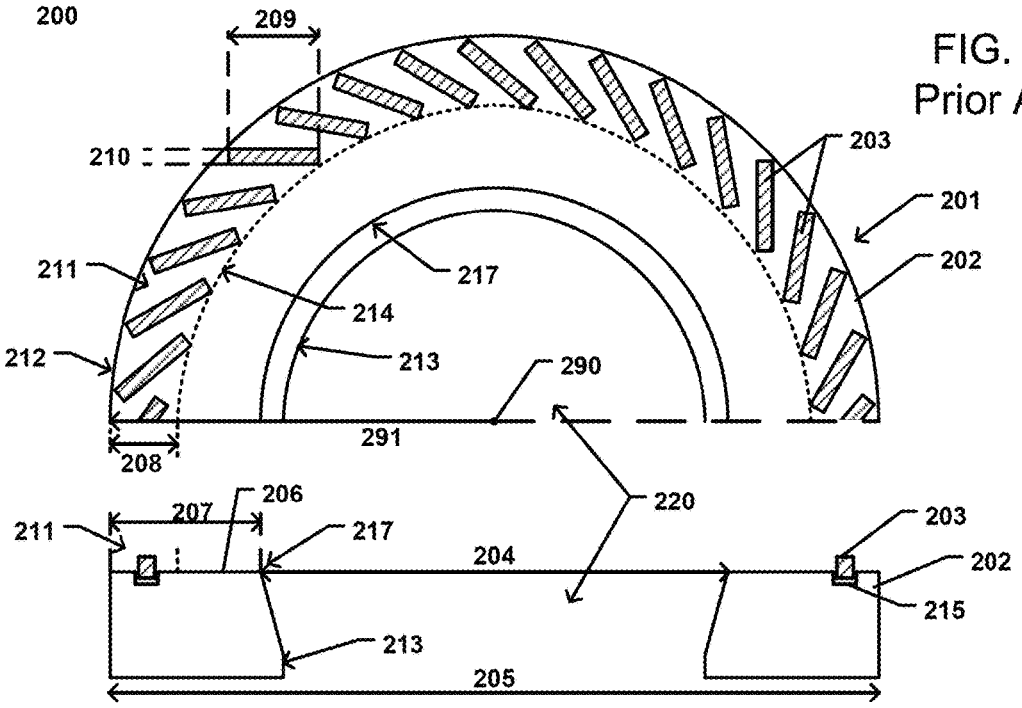
FIG. 2 Prior Art
FIG. 2 includes a top-down illustration of an abrasive article a conventional abrasive article.

FIG. 2 includes a top-down illustration of an abrasive article a conventional abrasive article. As illustrated, the abrasive article 200 can include a body 201 including a substrate 202, which may be referred to as a carrier. The abrasive article 200 further includes abrasive segments 203 bonded to a surface of the substrate 202. The abrasive segments 203 are generally contained within pockets 215 of the substrate 202. The abrasive segments 203 may be bonded within their respective pockets 215 to facilitate suitable bonding between the substrate 202 and the abrasive segments 203. The abrasive article 200 illustrated in FIG. 2 is only half of the abrasive article for ease of understanding.

The substrate 202 may be in the form of a wheel or disk having an annular shape including a central opening 220 defined by an inner diameter 204 and an outer diameter 205 extending through the midpoint 290 of the body 201 between the outer annular wall to 212. In accordance with an embodiment, the substrate 202 includes an inner annular wall 213 having tapered inner annular surface to 217 extending to the annular surface 206 to which the abrasive segments 203 are bonded. The annular surface 206 is defined as the surface extending between the inner annular surface to 217 to the outer annular surface 212 of the substrate 202. As such, the abrasive segments 203 are bonded to one of the major surfaces of the annular body 201. The annular surface 206 can have it annular width 207 defined as the radial distance along the annular surface 206, such as the distance between the inner annular surface 217 and outer annular surface 212 of the substrate 202 along radial axis 291.

The abrasive segments 203 can be coupled to the annular surface 206 and define an abrasive annular region 211. The abrasive annular region 211 can be defined as the portion of the annular surface 206 including the abrasive segments 203. That is, as illustrated in FIG. 2, the innermost points of the abrasive segments 203 define an inner annular circumference to 214 of the abrasive annular region 211. Furthermore, the abrasive annular region 211 can further be defined by an outer annular circumference defined as the circumference of the annular surface 206 including the outermost point of one or more of the abrasive segments 203. As illustrated FIG. 2, the outer annular circumference of the abrasive annular region 211 can be the same as the outer annular circumference 212 of the substrate 202. The abrasive annular region 211 can have an annular width 208 defined as the distance between the inner annular circumference 214 to the outer annular circumference 212 of the abrasive annular region 211 along a radial axis 290 extending from the midpoint 291 to the outer annular surface 212.

The abrasive segments 203 can have a length 209 defining the longest dimension of the abrasive segments 203 as viewed top-down as provided FIG. 2. Furthermore, the abrasive segments 203 can have a width 210 defined as the dimension extending substantially perpendicular to the length 209 of the abrasive segments 203. As illustrated, the abrasive segments 203 can have a length 209 that is greater than the annular width 208 of the abrasive annular region 211. Furthermore, the abrasive segments 203 can be angled with respect to the outer annular surface 212 of the substrate 202. Moreover, these conventional articles generally have a percent abrasive surface area of 25% and a NMCAV of approximately 0.158, which will be described in more detail herein.

Figure 3:
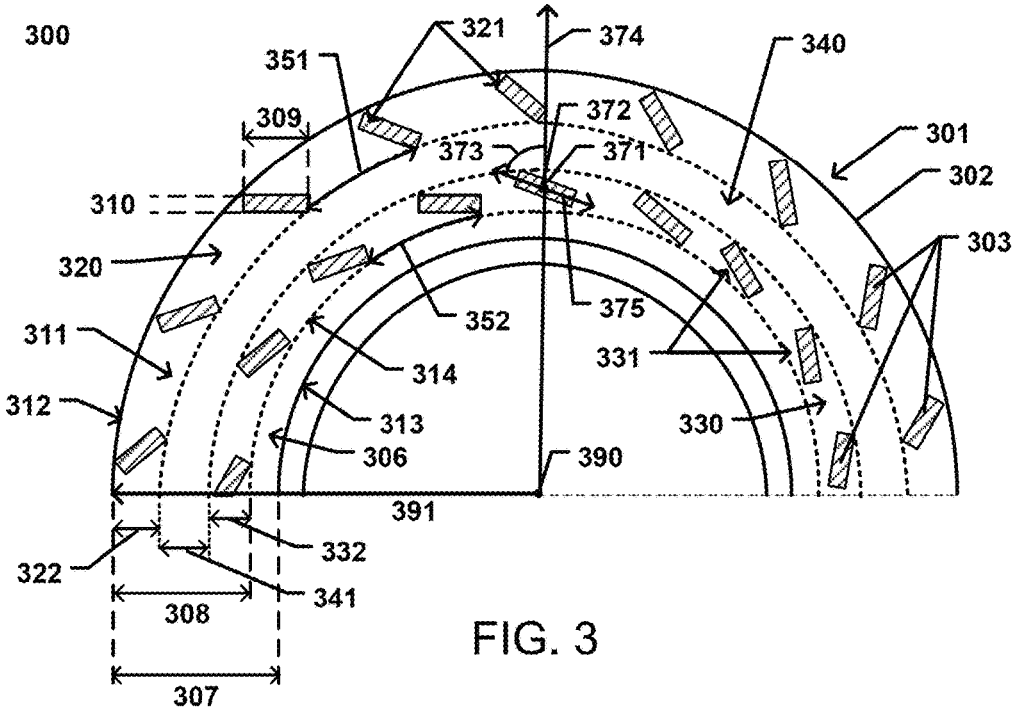
FIG. 3 includes a top down view of a portion of an abrasive article in accordance with an embodiment.

FIG. 3 includes a top-down view of a portion of an abrasive article in accordance with an embodiment. As illustrated, the abrasive article 300 can include a body 301 including a substrate 302 and abrasive segments 303 coupled to the substrate 302. The substrate 302 can include an annular surface 306 extending between the inner annular surface 313 and an outer annular surface 312. Furthermore, in the illustrated embodiment of FIG. 3, the abrasive article 300 can include an abrasive annular region 311 extending between an inner annular circumference 314 defining the circumference of a circular within the annular region 306 that intersects the inner most portion of at least one abrasive segment 303. Stated alternatively, the inner annular circumference is defined by the smallest circle that can be drawn that intersects with an innermost point on at least one abrasive segment 303. The abrasive annular region 311 can further be defined by an outer annular circumference 312 that defines a circumference of the largest circle within the annular region 306 that can be drawn to intersect a point of an abrasive segment furthest from the midpoint 390 of the body 301.

As illustrated, the annular region 306 can have an annular width 307 extending between the inner annular surface 313 at outer annular surface 312. The abrasive annular region 311 can have it annular width 308 defined as the distance between the inner annular circumference 314 and the outer annular circumference 312 along the radial axis 390. In accordance with an embodiment, the arrangement of the abrasive segments 303 can be can be distinct from conventional abrasive articles and can facilitate improved performance of the abrasive article 300, particularly during multi-wafer grinding operations.

In one particular embodiment, the abrasive annular region 311 can include an inner annular region 330, an outer annular region 320, and a central annular region 340 disposed between the inner annular region 330 and outer annular region 320. Each of the inner annular region 330, outer annular region 320, and central annular region may include a particular type and/or number of abrasive segments that can facilitate improved performance of the abrasive article 300, particularly in the context of multi-wafer grinding operations. In one embodiment, the abrasive article 300 can include a first group of abrasive segments 331 within an inner annular region 330 of the abrasive annular region 311. The inner annular region 330 can extend between the inner annular circumference 314 and an intermediate annular circumference 324 defining the outermost circumference intersecting at least one portion of an abrasive segment of the first group of abrasive segments 331.

In another embodiment, the outer annular region 320 can include a second group of abrasive segments 321. The outer annular region 320 can be defined as the region of the abrasive annular region 311 between the outer annular circumference 312 and an intermediate annular circumference 325 defining a circumference intersecting with an innermost portion of at least one abrasive segment of the second group of abrasive segments 321. As further illustrated, the central annular region 340 can be a region extending between the intermediate annular circumference 324 intermediate annular circumference 325. Is further illustrated, the inner annual region can have an annular width 332, the central annular region can have an annular width 341, and the outer annual region 320 can have an annular width 322. As illustrated, in accordance with one embodiment, the annular width 332 of the inner annual region 330 can be substantially the same as the annular width 340 and/or annular width 322. For example, in the illustrated embodiment, the annular widths 322, 341 and 332 can split the abrasive annular region 311 into substantially equal thirds. Still, it will be appreciated, that the annular widths 332, 341, and 322 can be significantly different with respect to each other depending upon the arrangement of the abrasive segments and the size and shape of abrasive segments 303.

In accordance with an embodiment, the first group of abrasive segments 330 can define a first distribution including a spacing distance 352, which is the shortest distance between two immediately adjacent abrasive segments along the inner annular circumference 314. As further illustrated, the second group of abrasive segments 321 can define a second distribution, which may be different than the first distribution of the first group of abrasive segments 331. Furthermore, the second group of abrasive segments 321 can define a spacing distance 351, which can be the closest distance between two immediately adjacent abrasive segments along the intermediate annular circumference 325 within the second group of abrasive segments 321. In accordance with an embodiment, the distribution of abrasive segments within the first group of abrasive segments 331 can be different than the distribution of abrasive segments within the second group of abrasive segments 321.

In accordance with an embodiment, the first group of abrasive segments 331 may have a particular spacing distance 352 that has a particular relationship relative to the average length of the abrasive segments within the first group of abrasive segments 331. For example, in at least one embodiment, the first group of abrasive segments 331 can have a spacing distance 352 of at least 0.01 (aL1), wherein aL1 represents an average length of the abrasive segments of the first group of abrasive segments 331. In another embodiment, the spacing distance 352 can be at least 0.1(aL1), such as at least 0.5(aL1), at least 1(aL1), at least 2(aL1), at least 3(aL1), at least 4(aL1), at least 5(aL1), at least 6(aL1), at least 7(aL1), at least 8(aL1), at least 9(aL1), or even at least 10(aL1). Still, in one non-limiting embodiment, the spacing distance 352 can be not greater than 100(aL1), such as not greater than 90(aL1), not greater than 90(aL1), not greater than 80(aL1), not greater than 70(aL1), not greater than 60(aL1), not greater than 50(aL1), not greater than 40(aL1), not greater than 30(aL1), not greater than 20(aL1), not greater than 15(aL1), not greater than 12(aL1), not greater than 10(aL1), not greater than 9(aL1), not greater than 8(aL1), not greater than 7(aL1), not greater than 6(aL1), not greater than 5(aL1), not greater than 4(aL1), not greater than 3(aL1), not greater than 2(aL1), not greater than 1(aL1), not greater than 0.1(aL1), such as not greater than 0.01(aL1). It will be appreciated that the spacing distance 352 can be within a range including any of the minimum and maximum values noted above.

In accordance with an embodiment, the second group of abrasive segments 321 may have a particular spacing distance 351 that has a particular relationship relative to the average length of the abrasive segments within the second group of abrasive segments 321. For example, in at least one embodiment, the second group of abrasive segments 321 can have a spacing distance 351 of at least 0.01 (aL2), wherein aL2 represents an average length of the abrasive segments of the second group of abrasive segments 321. In another embodiment, the spacing distance 351 can be at least 0.1 (aL2), such as at least 0.5(aL2), at least 1(aL2), at least 2(aL2), at least 3(aL2), at least 4(aL2), at least 5(aL2), at least 6(aL2), at least 7(aL2), at least 8(aL2), at least 9(aL2), or even at least 10(aL2). Still, in one non-limiting embodiment, the spacing distance 351 can be not greater than 100(aL2), such as not greater than 90(aL2), not greater than 90(aL2), not greater than 80(aL2), not greater than 70(aL2), not greater than 60(aL2), not greater than 50(aL2), not greater than 40(aL2), not greater than 30(aL2), not greater than 20(aL2), not greater than 15(aL2), not greater than 12(aL2), not greater than 10(aL2), not greater than 9(aL2), not greater than 8(aL2), not greater than 7(aL2), not greater than 6(aL2), not greater than 5(aL2), not greater than 4(aL2), not greater than 3(aL2), not greater than 2(aL2), not greater than 1(aL2), not greater than 0.1(aL2), such as not greater than 0.01(aL2). It will be appreciated that the spacing distance 351 can be within a range including any of the minimum and maximum values noted above.

In accordance with an embodiment, a particular relationship may exist between the length 309 of one or more abrasive segments 303 of the abrasive article 300 and the annular width 308 of the abrasive annular region 311. In accordance with an embodiment, the abrasive article 300 can include at least one abrasive segment having a length 303 that is less than the annular width 308 of the abrasive annular region 311. For example, in one particular embodiment, at least one of the abrasive segments 303 of the abrasive article can have a length 309 that is not greater than 95% of the annular width 308. In other instances, the length 309 of at least one abrasive segment 303 of the abrasive article 300 relative to the annular width 308 can be less, such as not greater than 90%, not greater than 85%, not greater than 80%, not greater than 75%, not greater than 70%, not greater than 65%, not greater than 60%, not greater than 55%, not greater than 50%, or even not greater than 45% of the annular width 308. Still, in one non-limiting embodiment, at least one of the abrasive segments 303 can have a length 309 that can be at least about 1%, such as at least about 5%, at least 10%, at least 15%, at least 20%, at least 25%, at least 30%, at least 35%, at least 40%, at least 45%, at least 50%, or even at least 55% of the annular width 308. It will be appreciated that the length 309 of at least one of the abrasive segments 303 relative to the annular width 308 can be within a range including any of the minimum and maximum percentages noted above.

In yet another embodiment, the abrasive segments 303 of the abrasive article 300 can include a longest abrasive segment having a length that may have a particular relationship relative to the annular width 308. For example, the longest abrasive segment can have a length 309 that is less than the annular width 308, including for example, not greater than 95% of the annular with, such as not greater than 90%, not greater than 85%, not greater than 80%, not greater than 75%, not greater than 70%, not greater than 65%, not greater than 60%, not greater than 55%, or even not greater than 50% of the annular width 308. Still, in at least one non-limiting embodiment, the longest abrasive segment of the abrasive segments 303 can have a length 309 of at least 10%, such as at least 15%, at least 20%, at least 25%, at least 30%, at least 35%, at least 40%, at least 45%, at least 50%, at least 55%, at least 60%, at least 65%, or even at least 70% of the annular width 308. It will be appreciated that in one embodiment, the longest abrasive segment of the abrasive segments 303 can have a length 309 that is within a range including any of the minimum and maximum percentages noted above.

In accordance with an embodiment, the abrasive segments 303 can define a total abrasive surface area for the abrasive article 300. The total abrasive surface area can include the two-dimensional surface area for all of the abrasive segments 303. For example, as illustrated in FIG. 3, each abrasive segment 303 can have a length 309 and a width 310 as viewed top-down. Therefore each abrasive segment 303 has an abrasive surface area (ASA). The total abrasive surface area (TASA) is the sum of the abrasive surface area for all of the abrasive segments 303 of the body 301. Furthermore, the body 301 can have a total surface area of the abrasive annular region 311 (Aaar). In accordance with one embodiment, the abrasive articles can have a particular percent abrasive surface area, which is the total abrasive surface area of the abrasive segments relative to the total surface area of the abrasive annular region 311. That is, the percent abrasive surface area is [(TASA/Aaar)×100%]. In accordance with an embodiment, the abrasive article can have a percent abrasive surface area of not greater than 24%, such as not greater than 23%, not greater than 22%, 21%, not greater than 20%, not greater than 19%, not greater than 18%, not greater than 70%, not greater than 60%, not greater than 50%, not greater than 14%, not greater than 13%, not greater than 12%, not greater than 11%, not greater than 10%, not greater than 9%, not greater than 8%, not greater than 7%, not greater than 6%, not greater than 5%, not greater than 4%, or even not greater than 3%. Still, in one non-limiting embodiment, the abrasive articles of the embodiments herein may have a percent abrasive surface area of at least 2%, such as least 3%, at least 4%, at least 5%, at least 6%, at least 7%, at least 80%, at least 9%, at least 10%, at least 11%, at least 12%, at least 13%, at least 14%, at least 15%, at least 16%, at least 17%, at least 18%, at least 19%, or even at least 20% for the total surface area of the abrasive annular region 311. It will be appreciated that the abrasive articles of the embodiments herein may have a percent abrasive surface area within a range including any of the minimum and maximum percentages noted above.

In still other instances, the abrasive segments or at least a portion of the abrasive segments 403 on the abrasive annular region 411 may have a longitudinal axis defined by the length of the abrasive segment that can be angled with respect to an associated radial axis. For example, in reference to FIG. 3, the abrasive segment 371 can have a longitudinal axis 375 extending through the midpoint. 372 of the abrasive surface of the abrasive segment 371. A radial axis 374 can extend through the midpoint 372 of the abrasive segment 371 and define an angle 373 between the radial axis 374 and longitudinal axis 375. The angle 373 can define an orientation angle 373, which in certain instances can be less than 90°, such as less than 80°, less than 85°, less than 82°, less than 80°, or even less than 75°. Still, in other instances, the orientation angle 373 may be at least 1°, such as at least 5°, or even at least 10°. It will be appreciated that the orientation angle 373 of any of the abrasive segments 303 can be varied to facilitate improved performance. Moreover, the abrasive segments 303 can have different orientation angles with respect to each other. Additionally, the orientation angle between abrasive segments 303 within the same annular region or between different annular regions can be different with respect to each other.

As noted, the body 301 can include abrasive segments 303. Each of the abrasive segments can have a body that is a bonded abrasive. The process of forming a bonded abrasive article can include the formation of a mixture. The mixture may be in a wet or dry form. Furthermore, the mixture may include certain components, including but not limited to, a bond material, abrasive particles, and a filler blend. It will be appreciated that other components may be added to the mixture to facilitate proper dispersion of the components within each other and further processing to form the finally-formed bonded abrasive article.

After properly forming the mixture, the process of forming the bonded abrasive can include forming a green body, which can be an unsintered body, which may undergo further treatment to form the finally-formed bonded abrasive. Suitable methods of forming the green body can include molding, pressing, casting, punching, printing, and a combination thereof. Optionally, forming of the green body may include drying of the green body to facilitate removal of volatiles and prepare the body for further processing.

After forming the green body, the process of forming the bonded abrasive article can continue by heating the green body to form a finally-formed bonded abrasive body. Heating of the green body may facilitate a phase transformation of one or more components of the body, including for example, a bond material. In certain instances, heating the body can be conducted at a temperature of at least about 375° C. to about 1000° C. In more particular instances, the forming process may include hot pressing, which can include applying heat and pressure to the green body, which may be applied separately or simultaneously. In accordance with one embodiment, the pressure applied can be at least about 0.5 tons/in$^2$ and not greater than about 3 tons/in$^2$.

After processing, the finally-formed abrasive article can include a bonded abrasive body including a certain content of bond material, a certain content of abrasive particles contained within the bond material, a filler material contained within the bond material, and some porosity within the volume of the bonded abrasive body.

In accordance with one embodiment, the body of the abrasive article can include abrasive particles having a particular average particle size (Pa) that may facilitate improved performance. For example, in one embodiment the abrasive particles can have an average particle size not greater than about 150 microns as calculated by an average number weighted. In yet another embodiment, the average particle size of the abrasive particles can be less, such is not greater than about 125 microns, not greater than about 100 microns, not greater than about 80 microns, or even not greater than about 50 microns. Still, in another non-limiting embodiment, the average particle size of the abrasive particles maybe at least about 0.1 microns, such as at least about 0.5 microns, at least about 1 micron, at least about 5 microns, or even at least about 10 microns. It will be appreciated that the average particle size of the abrasive particles maybe with in a range including any of the minimum and maximum values noted above.

In accordance with yet another aspect, the abrasive particles may have a certain aspect ratio (l:w), which is as a measurement of the length (l) of the particle as the longest dimension to the width (w) which is the second longest dimension of the particle perpendicular to the length. The aspect ratio of the abrasive particles may facilitate features and performance of the abrasive articles herein. For at least one embodiment, the abrasive particles can have an aspect ratio (l:w) of at least about 1.2:1, such as at least about 1.3:1, at least about 1.4:1, at least about 1.5:1, or even at least about 1.6:1. Still, in a non-limiting embodiment, the abrasive particles can have an aspect ratio of not greater than about 20:1, such as not greater than about 10:1. It will be appreciated that the abrasive particles can have an aspect ratio within a range including any of the minimum and maximum ratios noted above.

Furthermore, the abrasive particles can have a particular hardness with respect to filler particles that may be contained within the bonded abrasive. For example, the abrasive particles can have a hardness that is greater than the fine filler particle. In certain instances, the abrasive particles can have a hardness that is at least about 7 with respect Mohs hardness. In other embodiments, the abrasive particles can have a Mohs hardness of about 7.5, such as at least about 8, at least about 8.5, or even at least about 9.

In accordance with one embodiment, the abrasive particles can include an inorganic material. In certain instances, the abrasive particles may include a naturally occurring material. Still, in other instances, the abrasive particles maybe formed of a synthesized material. Some exemplary abrasive particles can include materials such as oxides, carbides, nitrides, borides, oxycarbides, oxynitrides, oxyborides, carbon-containing materials, diamond, and a combination thereof. The abrasive particles may include a superabrasive material, and more particularly, may consist essentially of a superabrasive material. For at least one embodiment, the abrasive particles can include diamond. And in still other instances, the abrasive particles may include cubic boron nitride. According to at least one non-limiting embodiment, the abrasive particles can consist essentially of diamond.

In some embodiments, the abrasive particles can include at least some content of polycrystalline diamond. For embodiments utilizing abrasive particles including diamond, the abrasive particles may have a particular content of polycrystalline diamond. For example, the content of polycrystalline diamond for the total content of abrasive particles may be at least about 20%, such as at least about 25%, at least about 30%, at least about 40%, at least about 50%, at least about 60%, at least about 70%, at least about 80%, or even at least about 90%. In at least one embodiment, essentially all of the diamond of the abrasive particles is a polycrystalline diamond material.

According to one aspect, the bonded abrasive may include a filler contained within the bond material. The filler may be present in a certain content to facilitate improved performance of the abrasive article. For example, the body can include a content of filler present in amount of not greater than about 10 vol % for a total volume of the bond material. In other instances, the content of the filler can be less, such as not greater than about 9 vol %, not greater than about 8 vol %, not greater than about 7 vol %, not greater than about 6 vol %, or even not greater than about 5.5 vol %. And still, in another non-limiting embodiment, the abrasive article can include a filler present in amount of at least about 0.2 vol % for a total volume of the bond material, such as at least about 0.5 vol %, at least about 1 vol %, at least about 2 vol %, or even at least about 3 vol %. It will be appreciated that the content of the filler can be present within a range including any of the mineral and maximum percentages noted above.

In accordance with an embodiment, the friable filler may be a particle having a certain Mohs hardness, such as not greater than about 5, not greater than about 4, not greater than about 3.5, not greater than about 3, not greater than about 2, or even not greater than about 1. Still, the filler contained within the bond material may have a Mohs hardness of at least about 0.1, such as at least about 1, at least about 1.5, or even at least about 2. It will be appreciated that the filler can have a Mohs hardness within a range between any of the minimum and maximum values noted above.

In accordance with an embodiment, the bonded abrasive body may have a certain content of porosity to facilitate suitable performance. For example, the porosity of the bonded abrasive for use as abrasive segments may be not greater than about 20 vol % for the total volume of the body. In other instances, the porosity can be not greater than about 15 vol %, not greater than about 12 vol %, not greater than about 10 vol %, not greater than about 8 vol %, not greater than about 5 vol %, or even not greater than about 3 vol %. Still, in at least one non-limiting embodiment, the porosity can be at least about 0.1 vol %, such as at least about 0.5 vol %, at least about 1 vol %, or even at least about 1.5 vol % for a total volume of the body of the bonded abrasive. It will be appreciated that the body can have a content of porosity within a range including any of the minimum and maximum percentages noted above.

In accordance with another embodiment, the abrasive body may have a certain content of the porosity that is closed porosity. For example, a majority of the porosity of the body may be closed porosity, which can be defined by discrete pores that are not necessarily connected to each other. In yet another embodiment, essentially all of the porosity within the body can be closed porosity.

In certain instances, the body of the abrasive article can be a bonded abrasive body having a bond matrix defining a three-dimensional matrix of material surrounding and containing the abrasive particles, fillers, and porosity. According to one embodiment, the bond material can include a metal or metal alloy. In particular embodiments, the bond material may include a transition metal element, and more particularly, may include a transition metal element, such as copper, tin, silver, nickel, and a combination thereof. In at least one embodiment, the bond material can include bronze including a combination of copper and tin. For example, the bond material including bronze may include a content of copper that is not less than a content of tin. In still other alternative embodiments, the bronze may include a content of copper that is greater than a content of tin.

In one aspect, the bonded abrasive body can include a bond material having a tin/copper ratio (Sn/Cu) of at least about 0.2 as measured by the weight or weight percent of the copper and tin. In other embodiments, the bronze can include a tin/copper ratio of at least about 0.23, such as at least about 0.25, at least about 0.28, at least about 0.3, at least about 0.33, at least about 0.35, at least about 0.38, at least about 0.4, at least about 0.43, at least about 0.45, at least about 0.48, at least about 0.5, at least about 0.53, at least about 0.55, at least about 0.58, at least about 0.6, at least about 0.63, at least about 0.65, at least about 0.68, at least about 0.7, at least about 0.73, at least about 0.75, at least about 0.78, at least about 0.8, or even at least about 0.9. In another non-limiting embodiment, the bond material can include a tin/copper ratio of not greater than about 0.93, not greater than about 0.9, not greater than about 0.88, not greater than about 0.85, not greater than about 0.83, not greater than about 0.8, not greater than about 0.78, not greater than about 0.75, not greater than about 0.73, not greater than about 0.7, not greater than about 0.68, not greater than about 0.65, not greater than about 0.63, not greater than about 0.6, not greater than about 0.58, not greater than about 0.55, not greater than about 0.53, not greater than about 0.5, not greater than about 0.48, not greater than about 0.45, not greater than about 0.43, not greater than about 0.4, not greater than about 0.3, not greater than about 0.2. It will be appreciated that the bond material can include bronze having a tin/copper ratio within a range including any of the minimum and maximum values noted above.

In at least one aspect, the bonded abrasive may include a particular content of bond material for the total volume of the body of the bonded abrasive. For example, the bonded abrasive may include at least about 50 vol % of the bond material for a total volume of the body, such as at least about 55 vol %, at least about 60 vol %, at least about 65 vol %, at least about 70 vol %, at least about 75 vol %, at least about 80 vol %, at least about 85 vol %, at least about 90 vol %, at least about 92 vol %, at least about 94 vol %, at least about 96 vol %, at least about 97 vol %, or even at least about 98 vol %. Still, in another non-limiting embodiment, the bonded abrasive may include not greater than about 99.5 vol % of the bond material for a total volume of the body, such as not greater than about 99 vol %, not greater than about 98 vol %, not greater than about 97 vol %, not greater than about 96 vol %, or even not greater than about 95 vol %. It will be appreciated that the bonded abrasive body may include a content of bond material within a range including any of the minimum and maximum percentages noted above.

In another embodiment, the bonded abrasive for use as the abrasive segments may include a particular content of abrasive particles for the total volume of the body of the bonded abrasive. For example, in certain instances, the bonded abrasive body may include at least about 0.1 vol % abrasive particles for a total volume of the body, such as at least about 0.25 vol % abrasive particle, at least about 0.5 vol %, at least about 0.6 vol %, at least about 0.7 vol %, at least about 0.8 vol %, at least about 0.9 vol %, at least about 1 vol %, at least about 2 vol %, at least about 3 vol %, at least about 4 vol %, or even at least about 5 vol %. In yet another non-limiting embodiment, the bonded abrasive may include not greater than about 15 vol % abrasive particles for a total volume of the body of the bonded abrasive, such as not greater than about 12 vol %, not greater than about 10 vol %, not greater than about 8 vol %, not greater than about 7 vol %, not greater than about 6 vol %, not greater than about 5 vol %, not greater than about 4 vol %, not greater than about 3 vol %, not greater than about 2 vol %, not greater than about 1.5 vol %. It will be appreciated that the content of abrasive particles for the total volume of the bonded abrasive body may be within a range including any of the minimum and maximum percentages noted above.

The abrasive article may include a limited content of certain materials, including for example phosphorous, zinc, antimony, chromium, cobalt, silicon, and a combination thereof. For example, in one embodiment, the content of any one of the foregoing materials can be not greater than about 1 vol %, such as not greater than about 0.08 vol %, such as not greater than about 0.05 vol %, or even not greater than about 0.01 vol % for the total volume of the bond material. Still, in certain non-limiting embodiments, the bond material may include a trace amount, such as at least about 0.001 vol % for the total volume of the bond material.

In another embodiment, the abrasive article maybe configured to conduct certain material removal operations. For example, the abrasive article may be configured to contact and grind the surfaces of certain wafers or substrates of material, including but not limited to amorphous, single crystalline, or polycrystalline materials. In particular instances, the abrasive article may be configured to grind particularly hard materials, such as sapphire. In still other instances, the abrasive articles herein may be configured for grinding of materials having a Vickers hardness of at least about 1500-3000 kg/mm$^2$.

Figure 4:
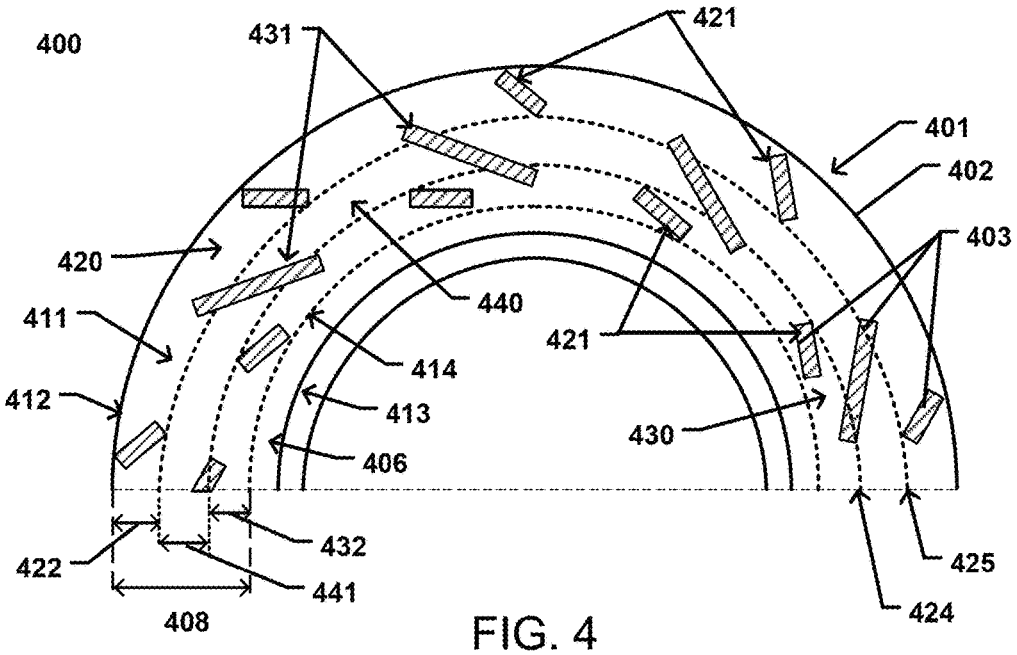
FIG. 4 includes a top down view of a portion of an abrasive article in accordance with an embodiment.

FIG. 4 includes an illustration of a portion of an abrasive article in accordance with an embodiment. As illustrated, the abrasive article 400 can include a body 401 including a substrate 402 and abrasive segments 403 coupled to the substrate 402. As further illustrated, the abrasive article 400 can include an annular surface 406 disposed between the inner annular surface 413 and outer annular surface 412. Furthermore, the abrasive article 400 can include an abrasive annular region 411 disposed between an inner annular circumference 414 and outer annular circumference 412 based upon the positioning of the abrasive segments 403 on the annular surface 406. Additionally, in one embodiment, the abrasive annular region 411 can included inner annular region 430, and outer annular region 420, and a central annular region 440 disposed between the inner annular region 430 and outer annular region 420. As described in embodiments herein, the inner annular region 43 can be defined as a region between the inner annular circumference 414 and intermediate annular circumference 424. Furthermore, the central annular region 440 can be defined as a region between the intermediate annular circumference 424 intermediate annular circumference 425. Finally, the outer annular region 420 can be defined as a region between the intermediate annular circumference 425 and the outer annular circumference 412.

As illustrated in the embodiment of FIG. 4 and according to one embodiment, the abrasive article 400 can include abrasive segments 403 that can have different dimensions relative to each other. For example, the abrasive segments 403 can include a first type of abrasive segments 431 that may have a different length relative to the other abrasive segments, such as the second type of abrasive segments 421. Utilizing abrasive segments having different shapes, sizes, and contours may facilitate improved performance. In particular, at least a portion of the abrasive segments 403, such as the first type of abrasive segments 431 can have a greater length relative to another portion of the abrasive segments 403, such as the second type of abrasive segments 421. In one embodiment, the abrasive segments 403 can include a first abrasive segment, such as one of the abrasive segments of the first type of abrasive segments 431 defining a first length (L1). The abrasive segments 403 may also include a second abrasive segment, such one of the abrasive segments of the second type of abrasive segments 421 that can have a second length (L2). In at least one embodiment, the first length can be different than the second length. Moreover, in certain instances, the first length can be greater than the second length. In one particular embodiment, the first length of the first segment and the second length of the second segment can define a ratio (L1:L2) of at least 1.1:1, such as at least 1.2:1, at least 1.5:1, at least 2:1, at least 3:1, at least 4:1, at least 5:1, at least 6:1, at least 7:1, at least 8:1, at least 9:1, at least 10:1. Still, in at least one non-limiting embodiment, the ratio of the first length to the second length (L1:L2) can be not greater than 100:1, such as not greater than 90:1, not greater than 80:1, not greater than 70:1, not greater than 60:1, not greater than 50:1, not greater than 40:1, not greater than 30:1, not greater than 20:1, not greater than 10:1, not greater than 8:1, not greater than 6:1, or even not greater than 4:1. It will be appreciated that the ratio of the first length and second length can be within a range including any of the minimum and maximum ratios noted above.

In accordance with another embodiment, the abrasive segments 403 of the abrasive article 400 can be separated into separate portions or types based upon their dimensions, including for example, abrasive segments of different lengths. For example, the abrasive segments 403 can include a first type of abrasive segments 431 that can have an average first length (aL1). The abrasive article 400 can include a second type of the abrasive segments 403 that can have a second average length (aL2). In one particular instance, the average first length can be different than the average second length. According to one embodiment, the first average length and the second average length can define a ratio (aL1:aL2) of at least 1.1:1, such as at least 1.2:1, at least 1.5:1, at least 2:1, at least 3:1, at least 4:1, at least 5:1, at least 6:1, at least 7:1, at least 8:1, at least 9:1, at least 10:1. Still, in at least one non-limiting embodiment, the ratio of the average first length to the average second length (aL1:aL2) can be not greater than 100:1, such as not greater than 90:1, not greater than 80:1, not greater than 70:1, not greater than 60:1, not greater than 50:1, not greater than 40:1, not greater than 30:1, not greater than 20:1, not greater than 10:1, not greater than 8:1, not greater than 6:1, or even not greater than 4:1. It will be appreciated that the ratio of the first length and second length can be within a range including In accordance with another embodiment, the different types of abrasive segments, including for example the first type abrasive segments 431 and second type of segments 421 can be disposed in different regions of the abrasive annular region 411 of the abrasive article 400. For example, in one embodiment, the inner annular region 430 or outer annular reason 420 include a different content of one or more types of the abrasive segments relative to another type of abrasive segment used on the same abrasive article 400. In particular, as illustrated in FIG. 4, the inner annular region 430 can include a greater content of the second type of abrasive segments 421 relative to the content of the first type of abrasive segments 431. Notably, very little, and in some instances, none of the first type of abrasive segments 431 are disposed (partially or entirely) with the inner annular region 430. Furthermore, in another embodiment, the second type of abrasive segments 421 can be disposed in the outer annular region 420. More particularly, the outer annular region 420 can included a greater content of the second type of abrasive segment 421 relative to the content of the first type of abrasive segment 431. In certain instances, such as illustrated in FIG. 4, the outer annular region 420 may include very little to no content of the first type of abrasive segment 431 relative to the second type of abrasive segment 421.

Furthermore, it will be appreciated that the central annular region 440 can include a particular content of the first type of abrasive segment 431 or second type abrasive segment 421 relative to each other and relative to the contents of the first and second types of abrasive segments 431 and 421 in other regions, such as the inner annular region 430 and outer in region 420. One particular embodiment, the central annular region 440 can include a greater content of the first type of abrasive segment 431 relative to the content of the second type of abrasive segment 421. In particular, the central annular region 440 may be essentially free of the second type of abrasive segments 421, such as illustrated in FIG. 4. That is, the central annular region 440 may consist entirely of only the first type of abrasive segment 431.

At least one embodiment, a greater content of the second type of abrasive segments 421 can intersect the inner annular circumference 414 of the abrasive annular region 411 compared to the content of first type of abrasive segments 431 intersecting the inner annular circumference 414. For another embodiment, a greater content of the second type of abrasive segments 421 can intersect the outer annular circumference 421 of the abrasive annular region 411 relative to the content of the first type of abrasive segments 431 intersecting the outer annular circumference 412 of the abrasive annular region 411. Moreover, in at least one embodiment, the first type of abrasive segments 431 may be spaced away from the inner annular circumference 414 and/or the outer annular circumference 412 of the abrasive annular region 411. For one embodiment, a greater content of the first type of abrasive segments 431 can be spaced away from the inner annular circumference 414 or outer annular circumference 412 compared to the content of the second type of abrasive segments 421 that are intersecting the inner annular circumference 414 or outer annular circumference 412.

In accordance with an embodiment, the abrasive segments 403 can include first type of abrasive segment 431 having a first abrasive surface area ASA1 and a second type of abrasive segments 421 having a second abrasive surface area (ASA2). In at least one embodiment, ASA1 can be greater than ASA2. In yet another embodiment, the first and second types of abrasive segments 431 and 421 can define an abrasive surface area ratio (ASA1:ASA2) of at least 1.1:1, such as at least 1.2:1, at least 1.5:1, at least 2:1, at least 3:1, at least 4:1, at least 5:1, at least 6:1, at least 7:1, at least 8:1, at least 9:1, or even at least 10:1. Still, in at least one non-limiting embodiment, the first and second types of abrasive segments 431 and 421 can define an abrasive surface area ratio (ASA1:ASA2) of not greater than 100:1, such as not greater than 90:1, not greater than 80:1, not greater than 70:1, not greater than 60:1, not greater than 60:1, not greater than 50:1, not greater than 40:1, not greater than 30:1, not greater than 20:1, not greater than 10:1, not greater than 8:1, not greater than 6:1, or even not greater than 4:1. It will be appreciated that the first and second types of abrasive segments 431 and 421 can define an abrasive surface area ratio (ASA1:ASA2) within a range including any of the minimum and maximum ratios noted above.

In accordance with an embodiment, the abrasive segments contained within the inner annular region 430 or outer annular region 420 may have a different abrasive surface area compared to one or more abrasive segments contained within the central annular region 440. Reference herein to an abrasive segment contained in a particular region is reference to an abrasive segment that has a majority of the surface area within one of the regions, and in particular instances, is contained entirely within the region. More particularly, as illustrated in FIG. 4, the second type of abrasive segments 421 within the inner annular region 430 can have a smaller surface area compared to the first type of abrasive segments 431 contained within the central annular region 440. Moreover, in one embodiment, second type of abrasive segments 421 within the outer annular region 420 can have a smaller surface area compared to the first type of abrasive segments 431 contained within the central annular region 440. It will be appreciated that abrasive articles of the embodiments herein can also have a difference in the abrasive surface area for the abrasive segments contained within the inner annular region 420 and the outer annular region 420.

The abrasive segments 403 may be arranged in a particular distribution with respect to each other within the abrasive annular region 411, which may facilitate improved performance. For example, in one embodiment, the abrasive segments 403 may define an alternating pattern with respect to the placement of the abrasive segments within various annular regions. More particularly, the alternative pattern can refer to the relative placement of abrasive segments between the outer annular region 420 and the central annular region 440. As illustrated in FIG. 4, the arrangement of the first type of abrasive segment 431 and second type of abrasive segment 421 alternates moving circumferentially around the body 401 between a first type of abrasive segment 431 and a second type of abrasive segment 421. More particularly, at least one abrasive segment of the second type of abrasive segments 421 contained in the outer annular region 420 can be disposed between two immediately adjacent abrasive segments of the first type of abrasive segments 431 within the central annular region 440.

In another embodiment, an alternating pattern may also be utilized for the abrasive segments disposed in the inner annular region 430 and the central annular region 440. For example, as illustrated in FIG. 4, the inner annular region 440 can include a first type of abrasive segment 421 having a shorter length compared to the first type of abrasive segment 431 disposed of the central annular region 440. Moreover, the arrangement of the first type of abrasive segment 421 in the central annular region 440 and second type of abrasive segment 421 in the inner annular region 430 alternates moving circumferentially around the body 401. According to an embodiment, at least one abrasive segment of the second type of abrasive segments 421 contained in the inner annular region 430 can be disposed between two immediately adjacent abrasive segments of the first type of abrasive segments 431 within the central annular region 440. It will be appreciated that while the embodiments here have made reference generally to three annular regions (i.e., an inner annular region, central annular region, and outer annular region) within a given abrasive annular region, it is contemplated that the abrasive articles of the embodiments herein may utilize a greater number or fewer number of abrasive regions. Moreover, to the extent that a non-circular tool, such as a non-circular substrate is used, including for example, a substrate having a polygonal or ellipsoidal two-dimensional shape, reference herein to circumferences are understood to be equally relevant to such tools. Moreover, the reference to circumferences and/or annular regions can apply to such tools and may be modified to have a similar polygonal or ellipsoidal shape as dictated by the two-dimensional shape of the substrate and arrangement of abrasive segments.

Figure 5:
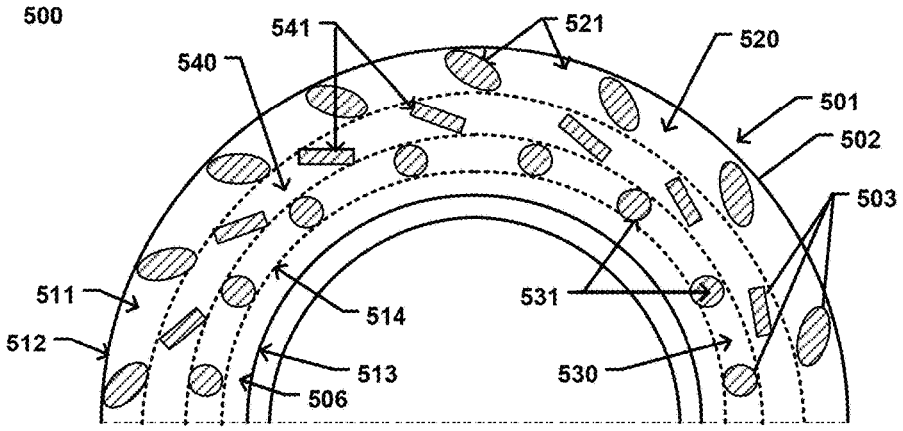
FIG. 5 includes a top down view of a portion of an abrasive article in accordance with an embodiment.
Figure 6A:
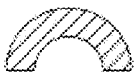
FIGS. 6A-6L include top-down views of different abrasive segments according to embodiments.
Figure 6B:
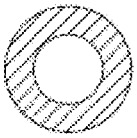
Figure 6C:
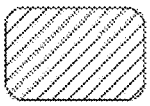
Figure 6D:
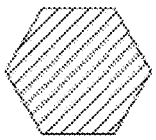
Figure 6E:
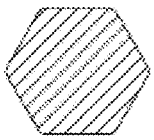
Figure 6F:
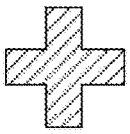
Figure 6G:
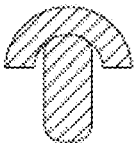
Figure 6H:
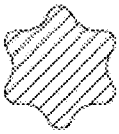
Figure 6I:
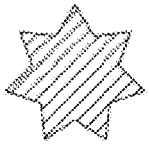
Figure 6J:
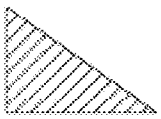
Figure 6K:
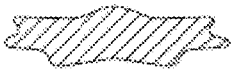
Figure 6L:
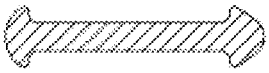

FIG. 5 includes a top-down illustration of a portion of an abrasive article according to an embodiment. The abrasive article 500 can include a body 501 including a substrate 502 and abrasive segments 503 coupled to the annular surface 506 of the substrate 502. The embodiment of FIG. 5 illustrates that various types of abrasive segments may be utilized in the same abrasive article. The various types of abrasive segments may be different from each other based on at least one abrasive segment feature including but not limited to, average particle size of the abrasive particles, abrasive content, maximum and/or minimum particle size of the abrasive particles, bond composition, bond content, average pore size, porosity content, minimum and/or maximum pore size, filler composition, average particle size of the filler, maximum and minimum particle size of one or more fillers, the two dimensional shape of the segments, the abrasive area of the segments, the dimensions of the segments, the placement of the segments, the orientation angle of the segments, the distribution of the segments on the annular surface including one or more annular regions (e.g., inner annular region, central annular region, outer annular region, etc.) of an abrasive annular region.

In at least one embodiment, the abrasive article 500 can include in inner annular region 530 including a first type of abrasive segments 531 having a first two-dimensional shape as viewed top-down, including in particular, a circular two-dimensional shape. Moreover, the abrasive article may include a second type of abrasive segments 541 contained substantially within the central annular region 540. The second type of abrasive segments 541 can have a different two-dimensional shape relative to the first type of abrasive segments 531 within the inner annular region 530. As illustrated, the second type of abrasive segments 541 can have a generally rectangular two-dimensional shape. The abrasive article 500 can have any of the features of the abrasive articles of the embodiments herein, including an annular surface 506, an inner annular surface 513, and abrasive annular surface 511 between an outer annular circumference 512 and inner annular circumference 514.

Moreover, in one embodiment, the abrasive article 500 can include a third type of abrasive segments 521 contained substantially within the outer annular region 520 and having a different two-dimensional shape compared to the first and second types of abrasive segments 531 and 541. The third type of abrasive segments 520 can have an ellipsoidal two-dimensional shape. In one particular embodiment, the abrasive segments 503 can include at least a first type of abrasive segment having a first two-dimensional shape, such as the first type of abrasive segments 531 which can have a different two-dimensional shape and/or abrasive area relative to the second and third types of abrasive segments 541 and 521. It will be noted that the difference in the two-dimensional shape of abrasive segments may be based upon size and/or contour of the segment. It will be appreciated that reference herein to a length of an abrasive segment is reference to a diameter for abrasive segments having a circular shape. In accordance with another embodiment, the abrasive segments can have a two-dimensional shape selected from the group consisting of a polygon, an irregular polygon, an ellipse, a circle, a body with one or more arms extending from a central region, a shape with at least one curved section, and a combination thereof.

In more particular terms, FIGS. 6A-6L include two-dimensional illustrations of various abrasive segments that may be employed in the abrasive articles of the embodiments herein. It should be noted that the abrasive segments illustrated in FIGS. 6A-6L is not exhaustive and other shapes for the abrasive segments may be utilized. It will be appreciate that they may be utilized in various annular regions with various orientations and/or sizes as suitable to facilitate desired performance of the abrasive article.

In accordance with another embodiment, at least one abrasive segment may span the inner annular region, the central annular region and the outer annular region of the annular surface. The at least one abrasive segment may further include a first end portion located in the inner annular region or the outer annular region of the annular surface. The at least one abrasive segment may further include a central portion located in the central annular region of the annular surface. The first end portion of the at least one abrasive segment may be distinct from the central portion of the at least one abrasive segment. Further, the first end portion may have a longitudinal axis and the central portion may have a longitudinal axis.

In accordance with certain embodiments, the longitudinal axis of the first end portion may be oriented at a particular angle relative to the longitudinal axis of the central portion. For example, the angle between the longitudinal axis of the first end portion and the longitudinal axis of the central portion may less than about 180 degrees, such as, less than about 170 degrees, less than about 160 degrees, less than about 150 degrees, less than about 140 degrees, less than about 130 degrees, less than about 120 degrees, less than about 110 degrees, less than about 100 degrees, less than about 90 degrees, less than about 85 degrees, less than about 80 degrees, less than about 75 degrees, less than about 70 degrees, less than about 65 degrees, less than about 60 degrees, less than about 55 degrees, less than about 50 degrees, less than about 45 degrees, less than about 40 degrees, less than about 35 degrees or even less than about 30 degrees. According to still other embodiments, the angle between the longitudinal axis of the first end portion and the longitudinal axis of the central portion may be at least about 10 degrees, such as, at least about 15 degrees, at least about 20 degrees, at least about 25 degrees, at least about 30 degrees, at least about 35 degrees, at least about 40 degrees, at least about 45 degrees, at least about 50 degrees, at least about 55 degrees or even at least about 60 degrees. It will be appreciated that the angle between the longitudinal axis of the first end portion and the longitudinal axis of the central portion may be any value between any of the minimum or maximum values noted above. It will be further appreciated that the angle between the longitudinal axis of the first end portion and the longitudinal axis of the central portion may be within a range between any of the minimum and maximum values noted above.

In accordance with yet another embodiment, the at least one abrasive segment may further include a second end portion located in the inner annular region or the outer annular region of the annular surface. The second end portion of the at least one abrasive segment may be distinct from the first end portion of the at least one abrasive segment and the central portion of the at least one abrasive segment. Further, the second end portion may have a longitudinal axis.

In accordance with certain embodiments, the longitudinal axis of the second end portion may be oriented at a particular angle relative to the longitudinal axis of the central portion. For example, the angle between the longitudinal axis of the second end portion and the longitudinal axis of the central portion may less than about 180 degrees, such as, less than about 170 degrees, less than about 160 degrees, less than about 150 degrees, less than about 140 degrees, less than about 130 degrees, less than about 120 degrees, less than about 110 degrees, less than about 100 degrees, less than about 90 degrees, less than about 85 degrees, less than about 80 degrees, less than about 75 degrees, less than about 70 degrees, less than about 65 degrees, less than about 60 degrees, less than about 55 degrees, less than about 50 degrees, less than about 45 degrees, less than about 40 degrees, less than about 35 degrees or even less than about 30 degrees. According to still other embodiments, the angle between the longitudinal axis of the second end portion and the longitudinal axis of the central portion may be at least about 10 degrees, such as, at least about 15 degrees, at least about 20 degrees, at least about 25 degrees, at least about 30 degrees, at least about 35 degrees, at least about 40 degrees, at least about 45 degrees, at least about 50 degrees, at least about 55 degrees or even at least about 60 degrees. It will be appreciated that the angle between the longitudinal axis of the second end portion and the longitudinal axis of the central portion may be any value between any of the minimum or maximum values noted above. It will be further appreciated that the angle between the longitudinal axis of the second end portion and the longitudinal axis of the central portion may be within a range between any of the minimum and maximum values noted above.

In accordance to still other embodiments, the longitudinal axis of the first end portion of the at least one abrasive segment may be parallel to the longitudinal axis of the second end portion of the at least one abrasive segment. In accordance with still other embodiments, the longitudinal axis of the first end portion may be oriented at a particular angle relative to the longitudinal axis of the second end portion. It will be appreciated since the first end portion and the second end portion may not necessarily connect, determining particular angle between the longitudinal axis of the first end portion and the longitudinal axis of the second end portion may require extending both axes until they intersect to determine the angle between them. For example, the angle between the longitudinal axis of the first end portion and the longitudinal axis of the second end portion may less than about 90 degrees, such as, less than about 85 degrees, less than about 80 degrees, less than about 75 degrees, less than about 70 degrees, less than about 65 degrees, less than about 60 degrees, less than about 55 degrees, less than about 50 degrees, less than about 45 degrees, less than about 40 degrees, less than about 35 degrees or even less than about 30 degrees. According to still other embodiments, the angle between the longitudinal axis of the first end portion and the longitudinal axis of the second end portion may be at least about 5 degrees, such as at least about 10 degrees, at least about 15 degrees, at least about 20 degrees, at least about 25 degrees, at least about 30 degrees, at least about 35 degrees, at least about 40 degrees, at least about 45 degrees, at least about 50 degrees, at least about 55 degrees or even at least about 60 degrees. It will be appreciated that the angle between the longitudinal axis of the first end portion and the longitudinal axis of the central portion may be any value between any of the minimum or maximum values noted above. It will be further appreciated that the angle between the longitudinal axis of the second end portion and the longitudinal axis of the central portion may be within a range between any of the minimum and maximum values noted above.

In accordance with still other embodiments, the first end portion may have a first abrasive surface area PASA1 and a second end portion may have a second abrasive surface area (PASA2). In at least one embodiment, PASA1 can be greater than PASA2. In yet another embodiment, the first and second portions of the abrasive segments can define an abrasive surface area ratio (PASA1:PASA2) of at least 1.1:1, such as, at least 1.2:1, at least 1.5:1, at least 2:1, at least 3:1, at least 4:1, at least 5:1, at least 6:1, at least 7:1, at least 8:1, at least 9:1, or even at least 10:1. Still, in at least one non-limiting embodiment, the first and second portions of abrasive segments can define an abrasive surface area ratio (PASA1:PASA2) of not greater than 100:1, such as not greater than 90:1, not greater than 80:1, not greater than 70:1, not greater than 60:1, not greater than 60:1, not greater than 50:1, not greater than 40:1, not greater than 30:1, not greater than 20:1, not greater than 10:1, not greater than 8:1, not greater than 6:1, or even not greater than 4:1. It will be appreciated that the first and second portions of abrasive segments can define an abrasive surface area ratio (PASA1:PASA2) of any value between any of the minimum and maximum values noted above. It will be further appreciated that the first and second portions of abrasive segments can define an abrasive surface area ratio (PASA1:PASA2) of any value within a range between any of the minimum and maximum ratios noted above.

In accordance with another embodiment, the first end portion of the abrasive segments may have a different length relative to length of the central portion. Utilizing abrasive segments having end portions and central portions of different shapes, sizes, and contours may facilitate improved performance. In particular, the central portion of the abrasive segments can have a greater length relative to first end portions of the abrasive segments. In one embodiment, the first end portions can define a first end portion length (PL1). The central portion can define a central portion length (PLC). In at least one embodiment, the first end portion length can be different than the central portion length. Moreover, in certain instances, the central portion length can be greater than the first end portion length. In one particular embodiment, the central portion length and the first end portion length can define a ratio (PLC:PL1) of at least 1.1:1, such as at least 1.2:1, at least 1.5:1, at least 2:1, at least 3:1, at least 4:1, at least 5:1, at least 6:1, at least 7:1, at least 8:1, at least 9:1, at least 10:1. Still, in at least one non-limiting embodiment, the ratio of the central portion length to the first end portion length (PLC:PL1) can be not greater than 100:1, such as not greater than 90:1, not greater than 80:1, not greater than 70:1, not greater than 60:1, not greater than 50:1, not greater than 40:1, not greater than 30:1, not greater than 20:1, not greater than 10:1, not greater than 8:1, not greater than 6:1, or even not greater than 4:1. It will be appreciated that the ratio of the central portion length and first end portion length can be within a range including any of the minimum and maximum ratios noted above.

In accordance with another embodiment, the second end portion of the abrasive segments may have a different length relative to length of the central portion. In particular, the central portion of the abrasive segments can have a greater length relative to second end portions of the abrasive segments. In one embodiment, the second end portions can define a first end portion length (PL2). The central portion can define a central portion length (PLC). In at least one embodiment, the second end portion length can be different than the central portion length. Moreover, in certain instances, the central portion length can be greater than the second end portion length. In one particular embodiment, the central portion length and the second end portion length can define a ratio (PLC:PL2) of at least 1.1:1, such as at least 1.2:1, at least 1.5:1, at least 2:1, at least 3:1, at least 4:1, at least 5:1, at least 6:1, at least 7:1, at least 8:1, at least 9:1, at least 10:1. Still, in at least one non-limiting embodiment, the ratio of the central portion length to the second end portion length (PLC:PL2) can be not greater than 100:1, such as not greater than 90:1, not greater than 80:1, not greater than 70:1, not greater than 60:1, not greater than 50:1, not greater than 40:1, not greater than 30:1, not greater than 20:1, not greater than 10:1, not greater than 8:1, not greater than 6:1, or even not greater than 4:1. It will be appreciated that the ratio of the central portion length and second end portion length can be within a range including any of the minimum and maximum ratios noted above.

In accordance with another embodiment, the first end portion of the abrasive segments may have a different length relative to length of the second end portion. Utilizing abrasive segments having end portions of different shapes, sizes, and contours may facilitate improved performance. In particular, the first end portion of the abrasive segments, can have a greater length relative to second end portions of the abrasive segments. In one embodiment, the first end portions can define a first end portion length (PL1). The second end portions can define a second end portion length (PL2). In at least one embodiment, the first end portion length can be different than the second end portion length. Moreover, in certain instances, the first end portion length can be greater than the second end portion length. In one particular embodiment, the first end portion length and the second end portion length can define a ratio (PL1:PL2) of at least 1.1:1, such as at least 1.2:1, at least 1.5:1, at least 2:1, at least 3:1, at least 4:1, at least 5:1, at least 6:1, at least 7:1, at least 8:1, at least 9:1, at least 10:1. Still, in at least one non-limiting embodiment, the ratio of the first end portion length to the second end portion length (PL1:PL2) can be not greater than 100:1, such as not greater than 90:1, not greater than 80:1, not greater than 70:1, not greater than 60:1, not greater than 50:1, not greater than 40:1, not greater than 30:1, not greater than 20:1, not greater than 10:1, not greater than 8:1, not greater than 6:1, or even not greater than 4:1. It will be appreciated that the ratio of the first end portion length and second end portion length can be within a range including any of the minimum and maximum ratios noted above.

In accordance with another embodiment, the central portion of the abrasive segments can have a particular length relative the annular width of the annular surface. For example, the central portion of at least one abrasive segment may have a length of at least 10% of the annular width, such as, at least 15%, or at least 20% or at least 25% or at least 30% or at least 35% or at least 40% or at least 45% or at least 50% or at least 55% or at least 60% or at least 65% or even at least 70%.

According to still other embodiments, at least one segment of the abrasive segments is generally flag-shaped. According to yet other embodiments, the abrasive segments are generally flag-shaped. According to still other embodiments, at least one segment of the abrasive segments is generally z-shaped. According to yet another embodiment, the abrasive segments are generally z-shaped.

FIG. 7 includes a generalized illustration of a plot of contact area versus angle of rotation of the chuck according to a contact area test. During operation of a multi-wafer grinding process, due to the orientation between the chuck, the arrangement of the wafers on the chuck, and the abrasive article, the abrasive surface area in contact with the wafers varies. The Applicants of the present application have noted that significant changes in the contact area may result in damage to the wafers. As illustrated in FIG. 7A, a first abrasive article 701 demonstrated a maximum contact area variation 711 as defined by the peak-to-peak change in the contact area.

Figure 7A:
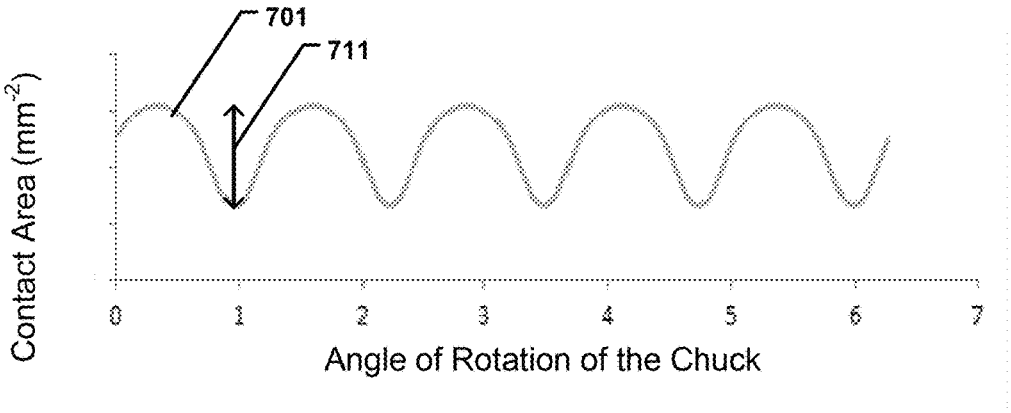
FIG. 7A includes a generalized illustration of a plot of contact area versus angle of rotation of the chuck for a contact area test.
Figure 7B:
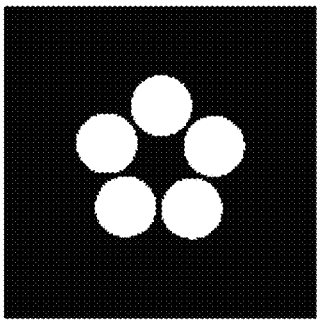
FIGS. 7B-7D include images used to analyze the normalized maximum contact area variation using a contact area test according to an embodiment.
Figure 7C:
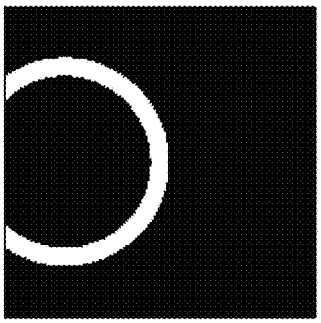
Figure 7D:
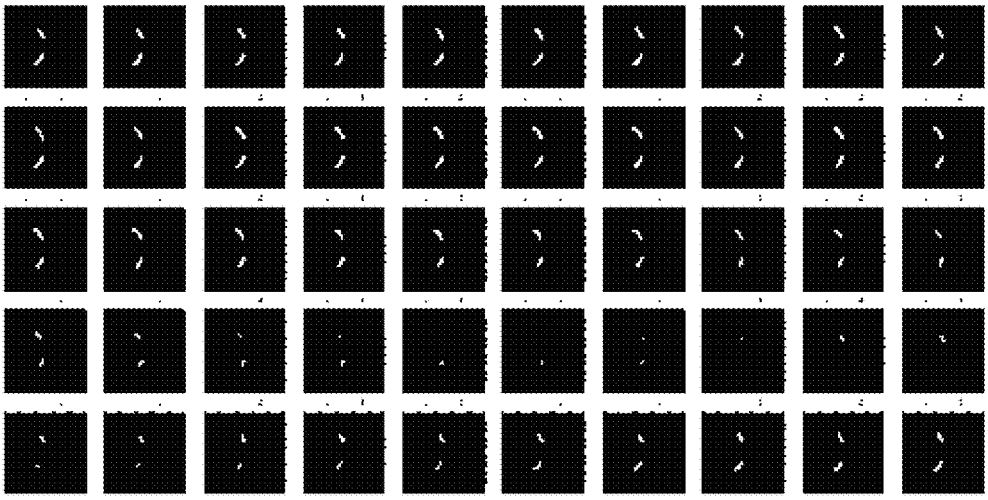

The contact area test is a standardized simulation of a multi-wafer grinding process using a compute algorithm written in Python. A scaled image of a standard arrangement of 5 wafers as arranged on a chuck in the multi-wafer grinding industry (i.e., pentagon pattern equally spaced apart around a center point in the center of the chuck) is created as shown in FIG. 7B, wherein the white regions identify the wafers and the black regions identify areas not including the wafers. The white regions are given a value of 1 and the black regions are given a value of 0. A second image representative of the abrasive annular region of the abrasive article is created to scale as shown in FIG. 7C. The edge of the abrasive annular region is centered over the center point of the image representing the center of the chuck as is representative of multi-wafer grinding operations in the industry. The white region is given a value of 1 and the black region is given a value of 0. Using the program, the wafers are rotated around the center point of the chuck (i.e., the center of the image) with angular step size of 2*pi/(N*50), wherein N represents the number of wafers, which according to the standardized contact area test has a value of 5.

Using the program, for each position, the total overlap area between the abrasive annular region and the wafers is calculated by overlapping and multiplying the images of the wafers and abrasive annular. Where there is no overlap between the white regions of the images of FIGS. 7B and 7C, the multiplication value is 0 (0×0 or 0×1). Where there is overlap between the white regions of both images of FIGS. 7B and 7C, the resulting value is 1. The total abrasive overlap area is then calculated by multiplying the total overlap area for each step through at least one full rotation (i.e., 360 degrees) of the image of the wafers. A representative mapping of the analyzed differences in overlap between images during rotation is provided in FIG. 7D. The resulting total abrasive overlap area is then multiplied by the percent abrasive surface area of the abrasive article, which is the percentage of the total surface area of the abrasive segments within the abrasive annular region.

According to one embodiment, the abrasive articles of the embodiments herein can have a normalized maximum contact area variation (NMCAV) of not greater than 0.150 according to a contact area test. The normalized maximum contact area variation is calculated by dividing the maximum contact area variation according to the contact area test by the total abrasive surface area of the abrasive article. The total abrasive surface area is the sum of the surface area of the abrasive segments on the abrasive article. In yet another embodiment, the NMCAV can be less, such as not greater than 0.149, not greater than 0.148, not greater than 0.147, not greater than 0.146, not greater than 0.145, not greater than 0.144, not greater than 0.143, not greater than 0.142, not greater than 0.141, not greater than 0.140, not greater than 0.139, not greater than 0.138, not greater than 0.137, not greater than 0.136, not greater than 0.135, not greater than 0.134, not greater than 0.133, not greater than 0.132, not greater than 0.131, not greater than 0.130, not greater than 0.129, not greater than 0.128, not greater than 0.127, not greater than 0.126, not greater than 0.125, not greater than 0.124, not greater than 0.123, not greater than 0.122, not greater than 0.121, not greater than 0.120, not greater than 0.119, not greater than 0.118, not greater than 0.117, not greater than 0.116, not greater than 0.115, not greater than 0.114, not greater than 0.113, not greater than 0.112, not greater than 0.111, not greater than 0.110, not greater than 0.109, not greater than 0.108, not greater than 0.107, not greater than 0.106, not greater than 0.105, not greater than 0.104, not greater than 0.103, not greater than 0.102, not greater than 0.101, not greater than 0.100, not greater than 0.095, not greater than 0.090, not greater than 0.085, not greater than 0.080, not greater than 0.075, not greater than 0.070, not greater than 0.065, not greater than 0.060, not greater than 0.055, not greater than 0.050, not greater than 0.045, not greater than 0.040, not greater than 0.035, not greater than 0.030, not greater than 0.025, not greater than 0.020, not greater than 0.015, not greater than 0.010, or even not greater than 0.005. Still, in at least one non-limiting embodiment, the NMCAV can be at least 0.0001, such as at least 0.0002, at least 0.0004, at least 0.0006, at least 0.0008, at least 0.001, at least 0.005, at least 0.01, at least 0.02, at least 0.04, at least 0.05, at least 0.06, or even at least 0.07.

It will be appreciated that the NMCAV can be within a range including any of the minimum and maximum values noted above.

Figure 8:
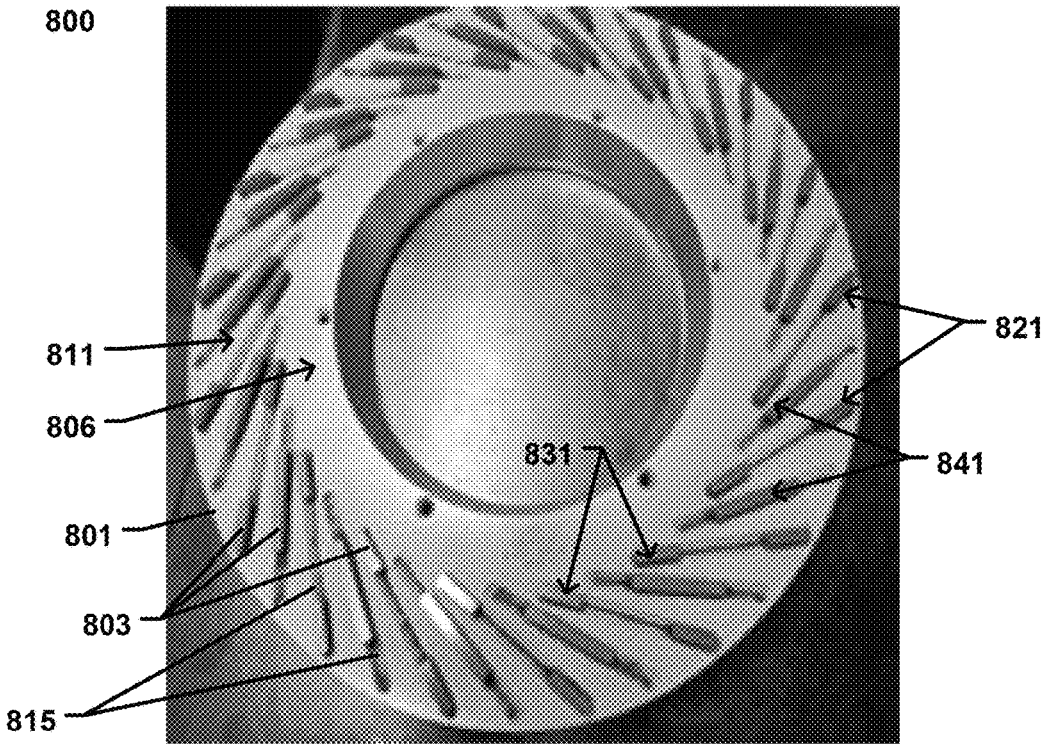
FIG. 8 includes an image of an abrasive article according to an embodiment.

FIG. 8 includes an image of an abrasive article according to an embodiment. The abrasive article 800 can include a body 801 including a substrate 802 and abrasive segments 803 coupled to the annular surface 806 of the substrate 802. The abrasive segments 803 can be contained in pockets 815 and may be bonded to the substrate 802 within the pockets 815. The abrasive article can include various types of abrasive segments in various annular regions within the abrasive annular region 811 defined by the inner most and outermost points of the abrasive segments 803 on the annular surface 806. The abrasive article 800 can include an inner annular region including a first type of abrasive segments 831, each of which have substantially the same rectangular two-dimensional shape compared to each other. Furthermore, the abrasive article includes a second type of abrasive segments 841 contained substantially within a central annular region. Each of the abrasive segments of the second type of abrasive segments 841 can have a generally rectangular two-dimensional shape, but are longer compared to the abrasive segments of the first type of abrasive segments 831. Moreover, the abrasive article 800 can include an outer annular region including a third type of abrasive segments 821, each of which can have substantially the same rectangular two-dimensional shape compared to each other. The abrasive segments of the first and third types of abrasive segments 831 and 821 can have substantially the same size and shape, and are significantly smaller in length and abrasive area compared to the second type of abrasive segments 831. The abrasive article has a percent abrasive surface area of less than 24% and NMCAV of approximately 0.098 according to the contact area test.

Figure 9:
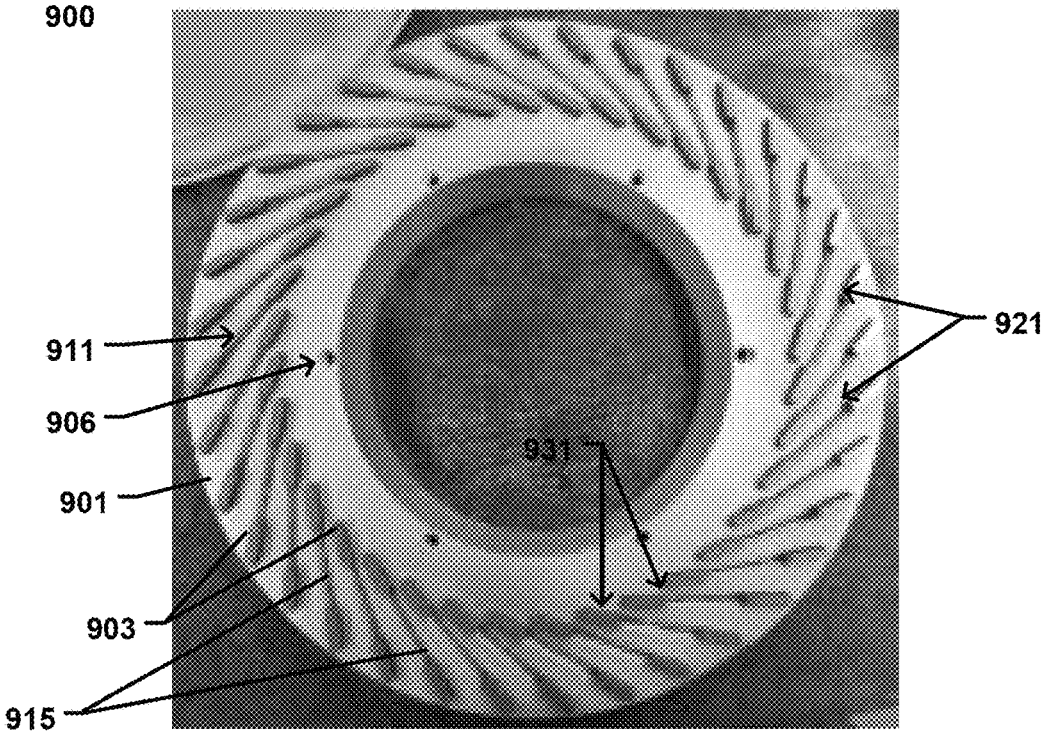
FIG. 9 includes an image of an abrasive article according to an embodiment.

FIG. 9 includes an image of an abrasive article according to an embodiment. The abrasive article 900 can include a body 901 including a substrate 902 and abrasive segments 903 coupled to the annular surface 906 of the substrate 902. The abrasive segments 903 can be contained in pockets 915 and may be bonded to the substrate 902 within the pockets 915. The abrasive article 900 can include various types of abrasive segments in various annular regions within the abrasive annular region 911 defined by the inner most and outermost points of the abrasive segments 903 on the annular surface 906. The abrasive article 900 can include an inner annular region including a first type of abrasive segments 931, each of which have substantially the same rectangular two-dimensional shape compared to each other. Furthermore, the abrasive article includes a second type of abrasive segments 921 contained substantially within an outer annular region. Each of the abrasive segments of the second type of abrasive segments 921 can have a generally rectangular two-dimensional shape, and in particular can have substantially the same rectangular two-dimensional shape compared to each other. The abrasive segments of the first and second types of abrasive segments 931 and 921 can have substantially the same size and shape and can be spaced apart from each other by a central annular region, which is substantially free of any abrasive segments. The abrasive article has a percent abrasive surface area of less than 24% and NMCAV of approximately 0.098 according to the contact area test.

Figure 10:
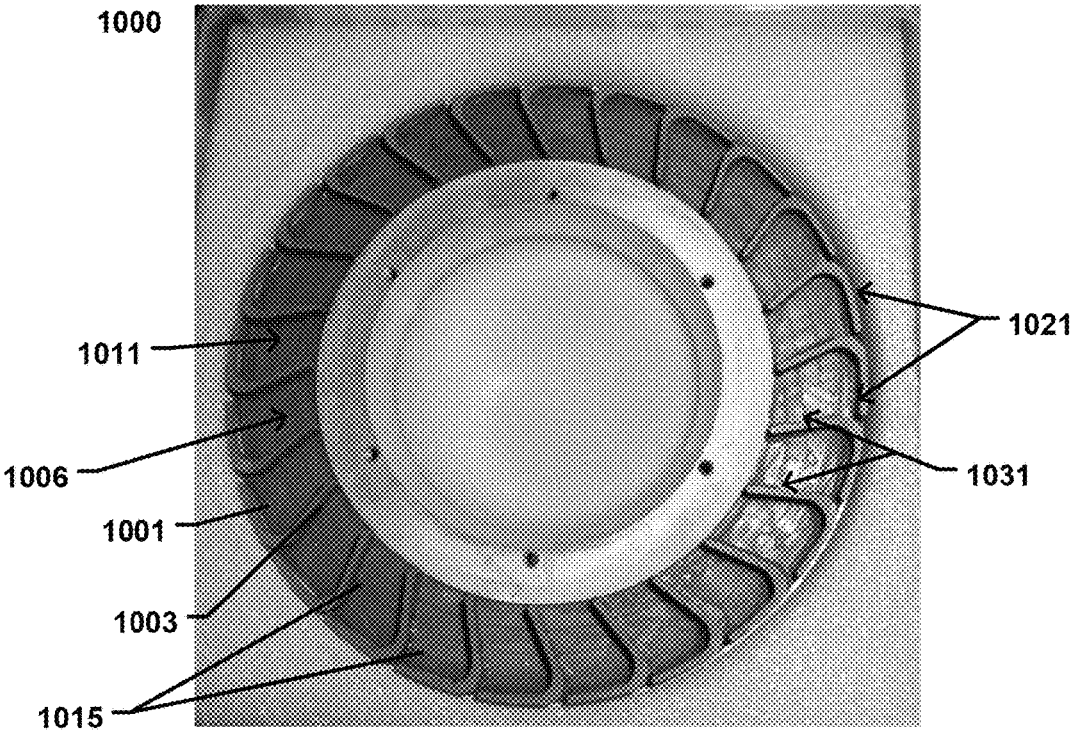
FIG. 10 includes an image of an abrasive article according to an embodiment.

FIG. 10 includes an image of an abrasive article according to an embodiment. The abrasive article 1000 can include a body 1001 including a substrate 1002 and abrasive segments 1003 coupled to the annular surface 1006 of the substrate 1002. The abrasive segments 1003 can be contained in pockets 1015 and may be bonded to the substrate 1002 within the pockets 1015. The abrasive article 1000 can include various flag-shaped abrasive segments 1003 spanning various annular regions within the abrasive annular region 1011. The abrasive article 1000 can include an inner annular region, a central annular region and an outer annular region. Furthermore, the abrasive segments 1003 includes a first end portion 1021 contained substantially within the outer annular region and a central portion 1031 contained substantially within the central annular region. Each of the first end portions 1021 have a longitudinal axis and each of the central portions 1031 have a longitudinal axis. An angel 1041 between the longitudinal axis of the first end portions 1021 and the longitudinal axis of the central portions 1031 is less than 180 degrees.

Figure 11:
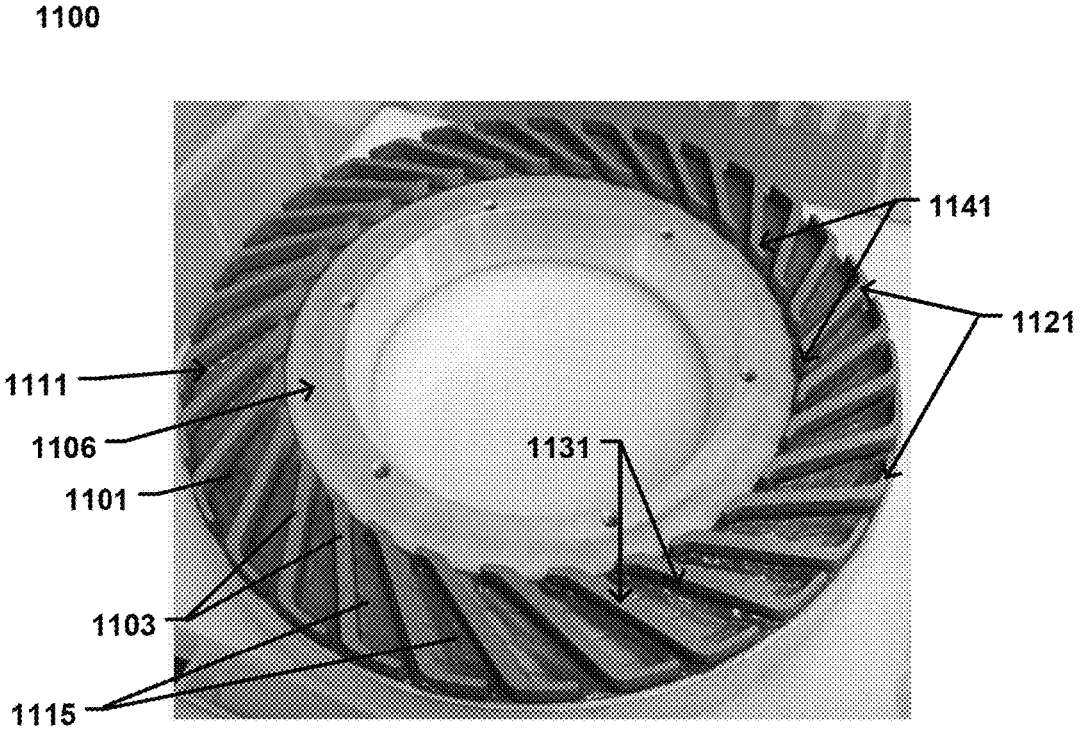
FIG. 11 includes an image of an abrasive article according to an embodiment.

FIG. 11 includes an image of an abrasive article according to an embodiment. The abrasive article 1100 can include a body 1101 including a substrate 1102 and abrasive segments 1103 coupled to the annular surface 1106 of the substrate 1102. The abrasive segments 1103 can be contained in pockets 1115 and may be bonded to the substrate 1102 within the pockets 1115. The abrasive article 1100 can include various z-shaped abrasive segments 1103 spanning various annular regions within the abrasive annular region 1111. The abrasive article 1100 can include an inner annular region, a central annular region and an outer annular region. Furthermore, the abrasive segments 1103 includes a first end portion 1121 contained substantially within the outer annular region, a central portion 1131 contained substantially within the central annular region and a second end portion 1141 contained substantially within the inner annular region. Each of the first end portions 1121 have a longitudinal axis, each of the central portions 1131 have a longitudinal axis and each of the second end portions 1141 have a longitudinal axis. An angel 1151 between the longitudinal axis of the first end portions 1121 and the longitudinal axis of the central portions 1131 is less than 180 degrees. An angel 1161 between the longitudinal axis of the second end portions 1141 and the longitudinal axis of the central portions 1131 is less than 180 degrees.

The abrasive articles of the embodiments herein represent a departure from the state of the art and may be particularly suitable for conducting multi-wafer grinding operations. In comparing the abrasive articles of the present embodiments with conventional abrasive articles it has been noted that the abrasive articles of the embodiments herein facilitate improved multi-wafer grinding operations with less damage to wafers and increased productivity.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the embodiments as listed below.

Embodiment 1

An abrasive article comprising: a body having an annular surface including abrasive segments coupled to the annular surface, wherein the abrasive segments define an abrasive annular region and a percent abrasive surface area of not greater than 24% for the total surface area of the abrasive annular region.

Embodiment 2

An abrasive article comprising: a body having an annular surface including abrasive segments coupled to the annular surface, wherein the abrasive segments define an abrasive annular region having an inner annular region, an outer annular region, and a central annular region disposed between the inner annular region and the outer annular region, and wherein at least one abrasive segment in the inner annular region or outer annular region has a different abrasive surface area compared to an abrasive segment in the central annular region.

Embodiment 3

An abrasive article comprising: a body having an annular surface including; a first abrasive segment coupled to the annular surface having a first abrasive surface area (ASA1); a second abrasive segment coupled to the annular surface having a second abrasive surface area (ASA2); and wherein ASA1>ASA2.

Embodiment 4

An abrasive article comprising: a body having an annular surface including abrasive segments coupled to the annular surface, wherein the abrasive segments define an abrasive annular region having an inner annular region, an outer annular region, and a central annular region disposed between the inner annular region and the outer annular region, and wherein the inner annular region comprises a first group of abrasive segments defining a first distribution and the central region comprises a second group of abrasive segments defining a second distribution, wherein the first distribution is different than the second distribution.

Embodiment 5

An abrasive article comprising: a body having an annular surface including abrasive segments coupled to the annular surface, wherein the abrasive segments define an abrasive annular region having an annular width defined as a distance between an inner annular circumference and an outer annular circumference along a radial axis, and wherein at least one abrasive segment extends for not greater than 95% of the annular width.

Embodiment 6

An abrasive article comprising: a body having an annular surface including abrasive segments including abrasive particles contained within a bond material, the abrasive segments coupled to the annular surface of the body and are arranged relative to each other to define a normalized maximum contact area variation (NMCAV) of not greater than 0.150 according to a contact area test.

Embodiment 7

The abrasive article of any one of embodiments 1, 2, 3, 4, 5, and 6, wherein the abrasive segments have a two-dimensional shape selected from the group consisting of a polygon, an irregular polygon, an ellipse, a circle, a body with one or more arms extending from a central region, a shape with at least one curved section, and a combination thereof.

Embodiment 8

The abrasive article of any one of embodiments 1, 2, 3, 4, 5, and 6, wherein the abrasive segments include a first type of abrasive segment including a first two-dimensional shape and a second type of abrasive segment having a second two-dimensional shape, wherein the first two-dimensional shape is different than the second two-dimensional shape in at least one of size, contour, and a combination thereof.

Embodiment 9

The abrasive article of any one of embodiments 1, 2, 3, 4, 5, and 6, wherein the abrasive segments include a first abrasive segment having a first length (L1) and a second abrasive segment having a second length (L2), and wherein L1 is different than L2.

Embodiment 10

The abrasive article of embodiment 9, wherein L1>L2.

Embodiment 11

The abrasive article of embodiment 9, wherein the first and second abrasive segments define a ratio (L1:L2) of at least 1.1:1 or at least 1.2:1 or at least 1.5:1 or at least 2:1 or at least 3:1 or at least 4:1 or at least 5:1 or at least 6:1 or at least 7:1 or at least 8:1 or at least 9:1 or at least 10:1.

Embodiment 12

The abrasive article of embodiment 9, wherein the first and second abrasive segments define a ratio (L1:L2) of not greater than 100:1 or not greater than 90:1 or not greater than 80:1 or not greater than 70:1 or not greater than 60:1 or not greater than 50:1 or not greater than 40:1 or not greater than 30:1 or not greater than 20:1 or not greater than 10:1 or not greater than 8:1 or not greater than 6:1 or not greater than 4:1.

Embodiment 13

The abrasive article of any one of embodiments 1, 2, 3, 4, 5, and 6, wherein the abrasive segments include a first portion including a first type of abrasive segments having an average first length (aL1) and a second portion including a second type of abrasive segments having an average second length (aL2), wherein the average first length is different than the average second length.

Embodiment 14

The abrasive article of embodiment 13, wherein aL1>aL2.

Embodiment 15

The abrasive article of embodiment 13, wherein the average first length and average second length define a ratio (aL1:aL2) of at least 1.1:1 or at least 1.2:1 or at least 1.5:1 or at least 2:1 or at least 3:1 or at least 4:1 or at least 5:1 or at least 6:1 or at least 7:1 or at least 8:1 or at least 9:1 or at least 10:1.

Embodiment 16

The abrasive article of embodiment 13, wherein the average first length and average second length define a ratio (aL1:aL2) of not greater than 100:1 or not greater than 90:1 or not greater than 80:1 or not greater than 70:1 or not greater than 60:1 or not greater than 50:1 or not greater than 40:1 or not greater than 30:1 or not greater than 20:1 or not greater than 10:1 or not greater than 8:1 or not greater than 6:1 or not greater than 4:1.

Embodiment 17

The abrasive article of embodiment 13, wherein the abrasive annular region includes an inner annular region, an outer annular region, and a central annular region disposed between the inner annular region and the outer annular region, and wherein the inner annular region or outer annular region include a greater content of the second type of abrasive segments compared to the content of the first type of abrasive segments.

Embodiment 18

The abrasive article of embodiment 13, wherein the abrasive annular region includes an inner annular region, an outer annular region, and a central annular region disposed between the inner annular region and the outer annular region, and wherein the central annular region include a greater content of the first type of abrasive segments compared to the content of the second type of abrasive segments.

Embodiment 19

The abrasive article of embodiment 13, wherein a greater content of the second type of abrasive segments intersect an inner annular circumference of the abrasive annular region compared to the content of the first type of abrasive segments.

Embodiment 20

The abrasive article of embodiment 13, wherein a greater content of the second type of abrasive segments intersect an outer annular circumference of the abrasive annular region compared to the content of the first type of abrasive segments.

Embodiment 21

The abrasive article of embodiment 13, wherein a greater content of the first type of abrasive segments are spaced away from an inner annular circumference or outer annular circumference of the abrasive annular region compared to the content of the second type of abrasive segments.

Embodiment 22

The abrasive article of any one of embodiments 2, 3, 4, 5, and 6, wherein the abrasive segments define an abrasive annular region and a percent abrasive surface area of not greater than 24% for the total surface area of the abrasive annular region.

Embodiment 23

The abrasive article of any one of embodiments 1 and 22, wherein the percent abrasive surface area is not greater than 23% or not greater than 22% or not greater than 21% or not greater than 20% or not greater than 19% or not greater than 18% or not greater than 17% or not greater than 16% or not greater than 15% or not greater than 14%.

Embodiment 24

The abrasive article of any one of embodiments 1, 2, 3, 4, 5, and 6, wherein the abrasive segments include a longest abrasive segment having a length that is less than an annular width of the abrasive annular region, wherein the longest abrasive segment has a length of not greater than 95% of the annular width or not greater than 90% or not greater than 85% or not greater than 80% or not greater than 75% or not greater than 70% or not greater than 65% or not greater than 60% or not greater than 55% or not greater than 50%.

Embodiment 25

The abrasive article of embodiment 24, wherein the longest abrasive segment has a length of at least 10% of the annular width or at least 15%, or at least 20% or at least 25% or at least 30% or at least 35% or at least 40% or at least 45% or at least 50% or at least 55% or at least 60% or at least 65% or at least 70%.

Embodiment 26

The abrasive article of any one of embodiments 1, 3, 4, 5, and 6, wherein the abrasive segments define an abrasive annular region having an inner annular region, an outer annular region, and a central annular region disposed between the inner annular region and the outer annular region, and wherein at least one abrasive segment in the inner annular region or outer annular region has a different abrasive surface area compared to an abrasive segment in the central annular region.

Embodiment 27

The abrasive article of any one of embodiments 2 and 26, wherein the at least one abrasive segment in the inner annular region or outer annular region comprises a smaller surface area compared to the abrasive segment in the central annular region.

Embodiment 28

The abrasive article of any one of embodiments 1, 2, 4, 5, and 6, wherein the body has an annular surface including a first abrasive segment coupled to the annular surface having a first abrasive surface area (ASA1) and a second abrasive segment coupled to the annular surface having a second abrasive surface area (ASA2), and wherein ASA1>ASA2.

Embodiment 29

The abrasive article of any one of embodiments 3 and 28, wherein the body comprises an abrasive surface area ratio (ASA1:ASA2) of at least 1.1:1 or at least 1.2:1 or at least 1.5:1 or at least 2:1 or at least 3:1 or at least 4:1 or at least 5:1 or at least 6:1 or at least 7:1 or at least 8:1 or at least 9:1 or at least 10:1.

Embodiment 30

The abrasive article of any one of embodiments 3 and 28, wherein the body comprises an abrasive surface area ratio (ASA1:ASA2) of not greater than 100:1 or not greater than 90:1 or not greater than 80:1 or not greater than 70:1 or not greater than 60:1 or not greater than 60:1 or not greater than 50:1 or not greater than 40:1 or not greater than 30:1 or not greater than 20:1 or not greater than 10:1 or not greater than 8:1 or not greater than 6:1 or not greater than 4:1.

Embodiment 31

The abrasive article of any one of embodiments 1, 2, 3 5, and 6, wherein the abrasive segments define an abrasive annular region having an inner annular region, an outer annular region, and a central annular region disposed between the inner annular region and the outer annular region, and wherein the inner annular region comprises a first group of abrasive segments defining a first distribution and the central region comprises a second group of abrasive segments defining a second distribution, wherein the first distribution is different than the second distribution.

Embodiment 32

The abrasive article of any one of embodiments 4 and 31, wherein a spacing distance between the first group of abrasive segments is different than a spacing distance between a second group of abrasive segments.

Embodiment 33

The abrasive article of any one of embodiments 4 and 31, wherein the spacing distance between the first group of abrasive segments is at least 0.01(aL1), wherein aL1 represents an average length of the abrasive segments of the first group or at least 0.1(aL1) or at least 0.5(aL1) or at least 1(aL1) or at least 2(aL1) or at least 3(aL1) or at least 4(aL1) or at least 5(aL1) or at least 6(aL1) or at least 7(aL1) or at least 8(aL1) or at least 9(aL1) or at least 10(aL1).

Embodiment 34

The abrasive article of any one of embodiments 4 and 31, wherein the spacing distance between the first group of abrasive segments is not greater than 100(aL1), wherein aL1 represents an average length of the abrasive segments of the first group or not greater than 90(aL1) or not greater than 90(aL1) or not greater than 80(aL1) or not greater than 70(aL1) or not greater than 60(aL1) or not greater than 50(aL1) or not greater than 40(aL1) or not greater than 30(aL1) or not greater than 20(aL1) or not greater than 15(aL1) or not greater than 12(aL1) or not greater than 10(aL1) or not greater than 9(aL1) or not greater than 8(aL1) or not greater than 7(aL1) or not greater than 6(aL1) or not greater than 5(aL1) or not greater than 4(aL1) or not greater than 3(aL1) or not greater than 2(aL1) or not greater than 1(aL1) or not greater than 0.1(aL1) or not greater than 0.01(aL1).

Embodiment 35

The abrasive article of any one of embodiments 4 and 31, wherein the spacing distance between the second group of abrasive segments is at least 0.01(aL2), wherein aL2 represents an average length of the abrasive segments of the second group or at least 0.1(aL2) or at least 0.5(aL2) or at least 1(aL2) or at least 2(aL2) or at least 3(aL2) or at least 4(aL2) or at least 5(aL2) or at least 6(aL2) or at least 7(aL2) or at least 8(aL2) or at least 9(aL2) or at least 10(aL2).

Embodiment 36

The abrasive article of any one of embodiments 4 and 31, wherein the spacing distance between the second group of abrasive segments is not greater than 100(aL2), wherein aL2 represents an average length of the abrasive segments of the second group or not greater than 90(aL2) or not greater than 90(aL2) or not greater than 80(aL2) or not greater than 70(aL2) or not greater than 60(aL2) or not greater than 50(aL2) or not greater than 40(aL2) or not greater than 30(aL2) or not greater than 20(aL2) or not greater than 15(aL2) or not greater than 12(aL2) or not greater than 10(aL2) or not greater than 9(aL2) or not greater than 8(aL2) or not greater than 7(aL2) or not greater than 6(aL2) or not greater than 5(aL2) or not greater than 4(aL2) or not greater than 3(aL2) or not greater than 2(aL2) or not greater than 1(aL2) or not greater than 0.1(aL2) or not greater than 0.01(aL2).

Embodiment 37

The abrasive article of any one of embodiments 1, 2, 3, and 4, wherein the abrasive segments define an abrasive annular region having an annular width defined as a distance between an inner annular circumference and an outer annular circumference along a radial axis, and wherein at least one abrasive segment extends for not greater than 95% of the annular width.

Embodiment 38

The abrasive article of any one of embodiments 5 and 37, wherein the at least one abrasive segment extends for not greater than 90% of the annular width or not greater than 85% or not greater than 80% or not greater than 75% or not greater than 70% or not greater than 65% or not greater than 60% or not greater than 55% or not greater than 50% or not greater than 45% of the annular width.

Embodiment 39

The abrasive article of any one of embodiments 5 and 37, wherein the at least one abrasive segment extends for at least 1% of the annular width or at least 5% or at least 10% or at least 15% or at least 20% or at least 25% or at least 30% or at least 35% or at least 40% or at least 45% or at least 50% or at least 55% of the annular width.

Embodiment 40

The abrasive article of any one of embodiments 1, 2, 3, 4, and 5, wherein the abrasive segments are coupled to the annular surface of the body and are arranged relative to each other to define a normalized maximum contact area variation (NMCAV) of not greater than 0.270 according to a contact area test.

Embodiment 41

The abrasive article of any one of embodiments 6 and 40, wherein the normalized maximum contact area variation (NMCAV) is not greater than 0.149, not greater than 0.148, not greater than 0.147, not greater than 0.146, not greater than 0.145, not greater than 0.144, not greater than 0.143, not greater than 0.142, not greater than 0.141, not greater than 0.140, not greater than 0.139, not greater than 0.138, not greater than 0.137, not greater than 0.136, not greater than 0.135, not greater than 0.134, not greater than 0.133, not greater than 0.132, not greater than 0.131, not greater than 0.130, not greater than 0.129, not greater than 0.128, not greater than 0.127, not greater than 0.126, not greater than 0.125, not greater than 0.124, not greater than 0.123, not greater than 0.122, not greater than 0.121, not greater than 0.120, not greater than 0.119, not greater than 0.118, not greater than 0.117, not greater than 0.116, not greater than 0.115, not greater than 0.114, not greater than 0.113, not greater than 0.112, not greater than 0.111, not greater than 0.110, not greater than 0.109, not greater than 0.108, not greater than 0.107, not greater than 0.106, not greater than 0.105, not greater than 0.104, not greater than 0.103, not greater than 0.102, not greater than 0.101, not greater than 0.100, not greater than 0.095, not greater than 0.090, not greater than 0.085, not greater than 0.080, not greater than 0.075, not greater than 0.070, not greater than 0.065, not greater than 0.060, not greater than 0.055, not greater than 0.050, not greater than 0.045, not greater than 0.040, not greater than 0.035, not greater than 0.030, not greater than 0.025, not greater than 0.020, not greater than 0.015, not greater than 0.010, or even not greater than 0.005. Still, in at least one non-limiting embodiment, the NMCAV can be at least 0.0001.

Embodiment 42

The abrasive article of any one of embodiments 6 and 40, wherein the NMCAV is at least 0.0001, at least 0.0002, at least 0.0004, at least 0.0006, at least 0.0008, at least 0.001, at least 0.005, at least 0.01, at least 0.02, at least 0.04, at least 0.05, at least 0.06, at least 0.07.

Embodiment 43

The abrasive article of any one of embodiments 1, 2, 3, 4, 5, and 6, wherein at least a portion of the abrasive segments comprise a longitudinal axis angled with respect to an associated radial axis.

Embodiment 44

The abrasive article of any one of embodiments 1, 2, 3, 4, 5, and 6, wherein the abrasive segments define an alternating pattern with respect to the placement of the abrasive segments in an inner annular region and central annular region.

Embodiment 45

The abrasive article of any one of embodiments 1, 2, 3, 4, 5, and 6, wherein the abrasive segments define an alternating pattern with respect to the placement of the abrasive segments in an outer annular region and central annular region.

Embodiment 46

The abrasive article of any one of embodiments 1, 2, 3, 4, 5, and 6, wherein the abrasive segments include bonded abrasive segments of abrasive particles contained in a three-dimensional volume of bond material.

Embodiment 47

The abrasive article of embodiment 46, wherein the abrasive particles comprise an inorganic material, wherein the abrasive particles comprise a naturally occurring material, wherein the abrasive particles comprise a synthesized material, wherein the abrasive particles comprise a material selected from the group consisting of oxides, carbides, nitrides, borides, oxycarbides, oxynitrides, oxyborides, carbon-containing materials, diamond, and a combination thereof, wherein the abrasive particles comprise a superabrasive material, wherein the abrasive particles consist essentially of diamond, wherein the abrasive particles comprise having a content of polycrystalline diamond.

Embodiment 48

The abrasive article of embodiment 46, wherein each abrasive segment includes a body comprising at least about 0.1 vol % abrasive particles for a total volume of the body, at least about 0.25 vol % abrasive particle, at least about 0.5 vol %, at least about 0.6 vol %, at least about 0.7 vol %, at least about 0.8 vol %, at least about 0.9 vol %, at least about 1 vol %, at least about 2 vol %, at least about 3 vol %, at least about 4 vol %, at least about 5 vol %.

Embodiment 49

The abrasive article of embodiment 46, wherein each of the abrasive segments have a body comprising not greater than about 15 vol % abrasive particles for a total volume of the body, not greater than about 12 vol %, not greater than about 10 vol %, not greater than about 8 vol %, not greater than about 7 vol %, not greater than about 6 vol %, not greater than about 5 vol %, not greater than about 4 vol %, not greater than about 3 vol %, not greater than about 2 vol %, not greater than about 1.5 vol %.

Embodiment 50

The abrasive article of embodiment 46, wherein each of the abrasive segments include a body configured to grind amorphous, single crystalline or polycrystalline materials, wherein the body is configured to grind wafers, wherein the body is configured to grind sapphire, wherein the body is configured for grinding of materials having a Vickers hardness of at least about 1500-3000 kg/mm2.

Embodiment 51

The abrasive article of embodiment 46, wherein the bond material comprises bronze including copper (Cu) and tin (Sn), wherein the bronze comprises a tin/copper ratio (Sn/Cu) by weight of not greater than about 0.93, not greater than about 0.9, not greater than about 0.88, not greater than about 0.85, not greater than about 0.83, not greater than about 0.8, not greater than about 0.78, not greater than about 0.75, not greater than about 0.73, not greater than about 0.7, not greater than about 0.68, not greater than about 0.65, not greater than about 0.63, not greater than about 0.6, not greater than about 0.58, not greater than about 0.55, not greater than about 0.53, not greater than about 0.5, not greater than about 0.48, not greater than about 0.45, not greater than about 0.43, not greater than about 0.4, not greater than about 0.3, not greater than about 0.2.

Embodiment 52

The abrasive article of embodiment 46, wherein each abrasive segment includes a body including at least about 50 vol % of the bond material for a total volume of the body, at least about 55 vol %, at least about 60 vol %, at least about 65 vol %, at least about 70 vol %, at least about 75 vol %, at least about 80 vol %, at least about 85 vol %, at least about 90 vol %, at least about 92 vol %, at least about 94 vol %, at least about 96 vol %, at least about 97 vol %, at least about 98 vol %.

Embodiment 53

The abrasive article of embodiment 46, wherein each abrasive segment includes a body comprising not greater than about 99.5 vol % bond material for a total volume of the body, not greater than about 99 vol %, not greater than about 98 vol %, not greater than about 97 vol %, not greater than about 96 vol %, not greater than about 95 vol %.

Embodiment 54

An abrasive article comprising: a body having an annular surface including abrasive segments coupled to the annular surface, wherein the abrasive segments define an abrasive annular region having an inner annular region, an outer annular region, and a central annular region disposed between the inner annular region and the outer annular region, and wherein at least one abrasive segment spans the inner annular region, the central annular region and the outer annular region; wherein first end portion of the at least one abrasive segment in the inner annular region or the outer annular region is distinct from a central portion of the at least one abrasive segment in the central annular region, and wherein an angle between a longitudinal axis of the first end portion and a longitudinal axis of the central portion is less than 180 degrees.

Embodiment 55

The abrasive article of embodiment 54, wherein the at least one abrasive segment further comprises a second end portion in the inner annular region or the outer annular region, and wherein an angle between a longitudinal axis of the second end portion and the longitudinal axis of the central portion is less than 180 degrees.

Embodiment 56

The abrasive article of embodiment 55, wherein the longitudinal axis of the first end portion is parallel to the longitudinal axis of the second end portion.

Embodiment 57

The abrasive article of any one of embodiments 54, 55, and 56, wherein the first end portion of the at least one abrasive segment has a first abrasive surface area ($PASA_1$) and the central portion of the at least one abrasive segment has a second abrasive surface area ($PASA_2$); and wherein $PASA_1 > PASA_2$.

Embodiment 58

The abrasive article of any one of embodiments 54, 55, and 56, wherein the first end portion has a first length (PL1) and the central portion has a second length (PLC), and wherein PL1 is different than PLC.

Embodiment 59

The abrasive article of embodiment 58, wherein PLC>PL1.

Embodiment 60

The abrasive article of embodiment 58, wherein the first end portion and central portion of the at least one segment defines a ratio (PLC:PL1) of at least 1.1:1 or at least 1.2:1 or at least 1.5:1 or at least 2:1 or at least 3:1 or at least 4:1 or at least 5:1 or at least 6:1 or at least 7:1 or at least 8:1 or at least 9:1 or at least 10:1.

Embodiment 61

The abrasive article of embodiment 58, wherein the first end portion and central portion of the at least one segment defines a ratio (PLC:PL1) of not greater than 100:1 or not greater than 90:1 or not greater than 80:1 or not greater than 70:1 or not greater than 60:1 or not greater than 50:1 or not greater than 40:1 or not greater than 30:1 or not greater than 20:1 or not greater than 10:1 or not greater than 8:1 or not greater than 6:1 or not greater than 4:1.

Embodiment 62

The abrasive article of any one of embodiments 54, 55, and 56, wherein the abrasive segments define an abrasive annular region and a percent abrasive surface area of not greater than 24% for the total surface area of the abrasive annular region.

Embodiment 63

The abrasive article of any one of embodiments 54, 55, and 56, wherein the percent abrasive surface area is not greater than 23% or not greater than 22% or not greater than 21% or not greater than 20% or not greater than 19% or not greater than 18% or not greater than 17% or not greater than 16% or not greater than 15% or not greater than 14%.

Embodiment 64

The abrasive article of any one of embodiments 54, 55, and 56, wherein the abrasive segments include a longest abrasive segment having a length that is less than an annular width of the abrasive annular region, wherein the longest abrasive segment has a length of not greater than 95% of the annular width or not greater than 90% or not greater than 85% or not greater than 80% or not greater than 75% or not greater than 70% or not greater than 65% or not greater than 60% or not greater than 55% or not greater than 50%.

Embodiment 65

The abrasive article of any one of embodiments 54, 55, and 56, wherein the central portion of at least one abrasive segment has a length of at least 10% of the annular width or at least 15%, or at least 20% or at least 25% or at least 30% or at least 35% or at least 40% or at least 45% or at least 50% or at least 55% or at least 60% or at least 65% or at least 70%.

Embodiment 66

The abrasive article of any one of embodiments 54, 55, and 56, wherein the abrasive segments define an abrasive annular region having an annular width defined as a distance between an inner annular circumference and an outer annular circumference along a radial axis, and wherein at least one abrasive segment extends for not greater than 95% of the annular width.

Embodiment 67

The abrasive article of any one of embodiments 54, 55, and 56, wherein the abrasive segments are coupled to the annular surface of the body and are arranged relative to each other to define a normalized maximum contact area variation (NMCAV) of not greater than 0.270 according to a contact area test.

Embodiment 68

The abrasive article of any one of embodiments 54, 55, and 56, wherein the normalized maximum contact area variation (NMCAV) is not greater than 0.149, not greater than 0.148, not greater than 0.147, not greater than 0.146, not greater than 0.145, not greater than 0.144, not greater than 0.143, not greater than 0.142, not greater than 0.141, not greater than 0.140, not greater than 0.139, not greater than 0.138, not greater than 0.137, not greater than 0.136, not greater than 0.135, not greater than 0.134, not greater than 0.133, not greater than 0.132, not greater than 0.131, not greater than 0.130, not greater than 0.129, not greater than 0.128, not greater than 0.127, not greater than 0.126, not greater than 0.125, not greater than 0.124, not greater than 0.123, not greater than 0.122, not greater than 0.121, not greater than 0.120, not greater than 0.119, not greater than 0.118, not greater than 0.117, not greater than 0.116, not greater than 0.115, not greater than 0.114, not greater than 0.113, not greater than 0.112, not greater than 0.111, not greater than 0.110, not greater than 0.109, not greater than 0.108, not greater than 0.107, not greater than 0.106, not greater than 0.105, not greater than 0.104, not greater than 0.103, not greater than 0.102, not greater than 0.101, not greater than 0.100, not greater than 0.095, not greater than 0.090, not greater than 0.085, not greater than 0.080, not greater than 0.075, not greater than 0.070, not greater than 0.065, not greater than 0.060, not greater than 0.055, not greater than 0.050, not greater than 0.045, not greater than 0.040, not greater than 0.035, not greater than 0.030, not greater than 0.025, not greater than 0.020, not greater than 0.015, not greater than 0.010, or even not greater than 0.005.

Embodiment 69

The abrasive article of any one of embodiments 54, 55, and 56, wherein the NMCAV is at least 0.0001, at least 0.0002, at least 0.0004, at least 0.0006, at least 0.0008, at least 0.001, at least 0.005, at least 0.01, at least 0.02, at least 0.04, at least 0.05, at least 0.06, at least 0.07.

Embodiment 70

The abrasive article of any one of embodiments 54, 55, and 56, wherein the longitudinal axis of the central portion of the abrasive segment is angled with respect to an associated radial axis.

Embodiment 71

The abrasive article of any one of embodiments 54, 55, and 56, wherein the abrasive segments include bonded abrasive segments of abrasive particles contained in a three-dimensional volume of bond material.

Embodiment 72

The abrasive article of embodiment 71, wherein the abrasive particles comprise an inorganic material, wherein the abrasive particles comprise a naturally occurring material, wherein the abrasive particles comprise a synthesized material, wherein the abrasive particles comprise a material selected from the group consisting of oxides, carbides, nitrides, borides, oxycarbides, oxynitrides, oxyborides, carbon-containing materials, diamond, and a combination thereof, wherein the abrasive particles comprise a superabrasive material, wherein the abrasive particles consist essentially of diamond, wherein the abrasive particles comprise having a content of polycrystalline diamond.

Embodiment 73

The abrasive article of embodiment 71, wherein each abrasive segment includes a body comprising at least about 0.1 vol % abrasive particles for a total volume of the body, at least about 0.25 vol % abrasive particle, at least about 0.5 vol %, at least about 0.6 vol %, at least about 0.7 vol %, at least about 0.8 vol %, at least about 0.9 vol %, at least about 1 vol %, at least about 2 vol %, at least about 3 vol %, at least about 4 vol %, at least about 5 vol %.

Embodiment 74

The abrasive article of embodiment 71, wherein each of the abrasive segments have a body comprising not greater than about 15 vol % abrasive particles for a total volume of the body, not greater than about 12 vol %, not greater than about 10 vol %, not greater than about 8 vol %, not greater than about 7 vol %, not greater than about 6 vol %, not greater than about 5 vol %, not greater than about 4 vol %, not greater than about 3 vol %, not greater than about 2 vol %, not greater than about 1.5 vol %.

Embodiment 75

The abrasive article of embodiment 71, wherein each of the abrasive segments include a body configured to grind amorphous, single crystalline or polycrystalline materials, wherein the body is configured to grind wafers, wherein the body is configured to grind sapphire, wherein the body is configured for grinding of materials having a Vickers hardness of at least about 1500-3000 kg/mm$^2$.

Embodiment 76

The abrasive article of embodiment 71, wherein the bond material comprises bronze including copper (Cu) and tin (Sn), wherein the bronze comprises a tin/copper ratio (Sn/Cu) by weight of not greater than about 0.93, not greater than about 0.9, not greater than about 0.88, not greater than about 0.85, not greater than about 0.83, not greater than about 0.8, not greater than about 0.78, not greater than about 0.75, not greater than about 0.73, not greater than about 0.7, not greater than about 0.68, not greater than about 0.65, not greater than about 0.63, not greater than about 0.6, not greater than about 0.58, not greater than about 0.55, not greater than about 0.53, not greater than about 0.5, not greater than about 0.48, not greater than about 0.45, not greater than about 0.43, not greater than about 0.4, not greater than about 0.3, not greater than about 0.2.

Embodiment 77

The abrasive article of embodiment 71, wherein each abrasive segment includes a body including at least about 50 vol % of the bond material for a total volume of the body, at least about 55 vol %, at least about 60 vol %, at least about 65 vol %, at least about 70 vol %, at least about 75 vol %, at least about 80 vol %, at least about 85 vol %, at least about 90 vol %, at least about 92 vol %, at least about 94 vol %, at least about 96 vol %, at least about 97 vol %, at least about 98 vol %.

Embodiment 78

The abrasive article of embodiment 71, wherein each abrasive segment includes a body comprising not greater than about 99.5 vol % bond material for a total volume of the body, not greater than about 99 vol %, not greater than about 98 vol %, not greater than about 97 vol %, not greater than about 96 vol %, not greater than about 95 vol %.

Embodiment 79

The abrasive article of any one of embodiments 54 and 55, wherein the at least one segment is generally flag-shaped.

Embodiment 80

The abrasive article of any one of embodiments 54, 55, and 56, wherein the at least one segment has a generally z-shaped.

Embodiment 81

A method of removing material from a plurality of substrates using any one of the abrasive articles from any one of embodiments 1, 2, 3, 4, 5, 6, 54, 55 and 56.

Examples

Four sample abrasive grinding wheels (SGW1, SGW2, SGW3 & SGW4) were prepared according to embodiments described herein. Sample abrasive grinding wheel SGW1 included abrasive segments arranged in a generally half-split segment design as shown in FIG. 8. Sample abrasive grinding wheel SGW2 included abrasive segments arranged in a generally full split segment design as shown in FIG. 9. Sample Abrasive grinding wheel SGW3 included abrasive segments that were generally flag-shaped in design and arranged as shown in FIG. 10. Abrasive grinding wheel SGW4 included abrasive segments that were generally z-shaped in design and arranged as shown in FIG. 11.

A comparative abrasive grinding wheel (CGW1) was also prepared. Comparative abrasive grinding wheel CGW1 included straight, single sized abrasive segments arranged generally as shown in FIG. 2.

Abrasive grinding wheels SGW1, SGW2, SGW3, SGW4 and CGW1 were tested for grinding performance by measuring total thickness variation (TTV) according to parameters set forth in Table 1 below.

TABLE 1

Grinding Performance Test Parameters

| APPLICATION DESCRIPTION | PERFORMANCE PARAMETERS | TARGET VALUES FOR TEST |
|---|---|---|
| 4" × 5 pcs standard wafer grinding under high federate (no paper backing) | Ws/Wp/F1/F2 | 1000/60/50/30 |
| | Initial/Final Thickness | 650/120 |
| | Wheel Wear (%) | 3.3~3.6% |
| | Load (%) | 22% |

Grinding performance achieved by each of sample abrasive grinding wheels SGW1, SGW2, SGW3 and SGW4 and comparative abrasive grinding wheel CGW1 is summarized in Table 2 below.

TABLE 2

Grinding Performance Summary

| Samples | TTV (μm) | Scratch | Edge Chips | Ra (μm) | Life (%) | Load (wheel/normal force) |
|---|---|---|---|---|---|---|
| SGW1 | 3 (+/−1) | — | — | — | — | — |
| SGW2 | 6 (+/−2) | — | — | — | — | — |
| SGW3 | 4.5 (+/−0.5) | Yes | Yes (2~3) | 0.4~0.5 | 16 | 23/8 |
| SGW4 | 3.5 (+/−0.5) | Very Shallow and Minimal | Negligible, slight | 0.3~0.35 | 8 | 25/8 |
| CGW1 | 12 (+/−4) | — | — | — | — | — |

Figure 12:
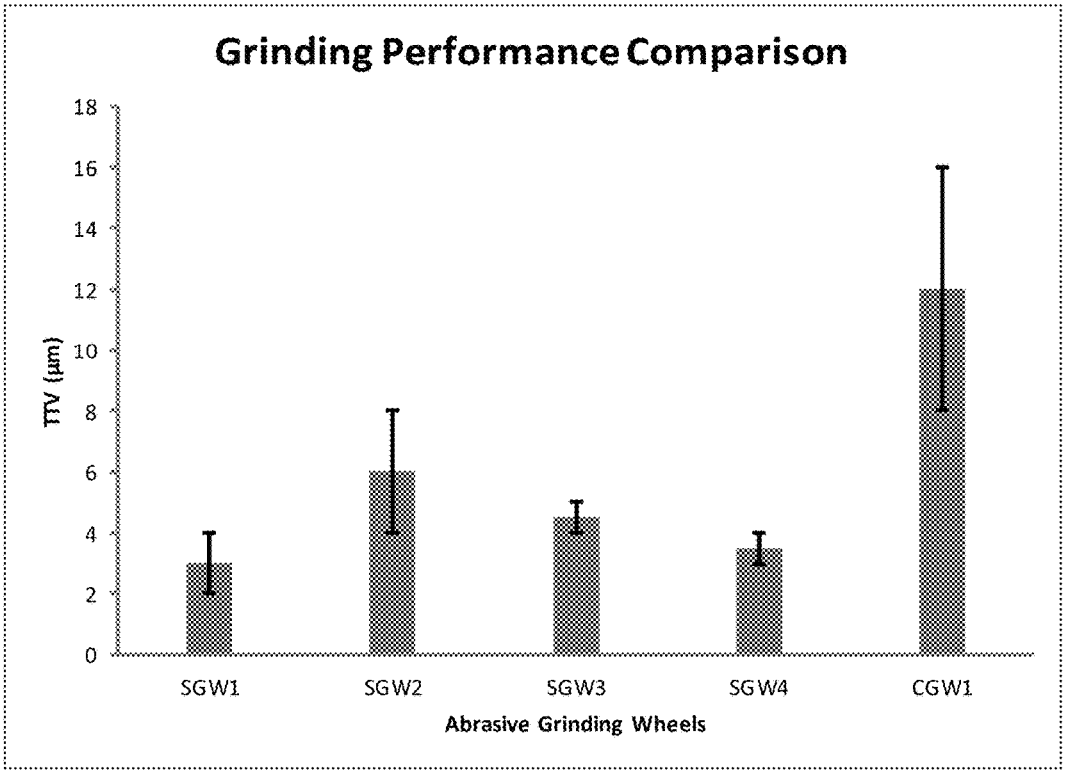
FIG. 12 includes a plot comparing the grinding performance of sample abrasive articles according to embodiments described herein with the grinding performance of a comparative abrasive article.

FIG. 12 illustrates a plot comparing the grinding performance of sample abrasive grinding wheels SGW1, SGW2, SGW3, and SGW4 with the grinding performance of comparative abrasive grinding wheel CGW1. As shown in FIG. 12, all four sample abrasive grinding wheels SGW1, SGW2, SGW3, and SGW4 showed improved (i.e., lower) TTV performance than the comparative abrasive grinding wheel CGW1. In particular, sample abrasive grinding wheel SGW2 showed nearly a 2× improvement in TTV grinding performance over the comparative abrasive grinding wheel CGW1 (i.e., approximately 50% less TTV during the grinding test). Further, sample abrasive grinding wheels SGW1, SGW3, and SGW4 showed at least a 3× improvement in TTV grinding performance over the comparative abrasive grinding wheel CGW1 (i.e., approximately 66% less TTV during grinding the grinding test).

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description of the Drawings, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description of the Drawings, with each claim standing on its own as defining separately claimed subject matter.

What is claimed is:

1. An abrasive article comprising:

a body having an annular surface including abrasive segments coupled to the annular surface, wherein the abrasive segments define an abrasive annular region having an inner annular region, an outer annular region, and a central annular region disposed between the inner annular region and the outer annular region, wherein the abrasive segments include a first abrasive segment having a first length (L1) and a second abrasive segment having a second length (L2), and wherein L1 is different than L2, wherein at least one abrasive segment in the inner annular region or outer annular region has a different abrasive surface area compared to an abrasive segment in the central annular region, and wherein the abrasive article further comprises a percent abrasive surface area of not greater than 24% for a total surface area of the abrasive annular region.

2. The abrasive article of claim 1, wherein the abrasive segments have a two-dimensional shape selected from the group consisting of a polygon, an irregular polygon, an ellipse, a circle, a body with one or more arms extending from a central region, a shape with at least one curved section, and a combination thereof.

3. The abrasive article of claim 1, wherein L1>L2.

4. The abrasive article of claim 1, wherein the body has an annular surface including a first abrasive segment coupled to the annular surface having a first abrasive surface area (ASA1) and a second abrasive segment coupled to the annular surface having a second abrasive surface area (ASA2), and wherein ASA1>ASA2.

5. The abrasive article of claim 1, wherein the abrasive segments define an abrasive annular region having an inner annular region, an outer annular region, and a central annular region disposed between the inner annular region and the outer annular region, and wherein the inner annular region comprises a first group of abrasive segments defining a first distribution and the central region comprises a second group of abrasive segments defining a second distribution, wherein the first distribution is different than the second distribution.

6. The abrasive article of claim 1, wherein the abrasive segments have a two-dimensional shape selected from the group consisting of a polygon, an irregular polygon, an ellipse, a circle, a body with one or more arms extending from a central region, a shape with at least one curved section, and a combination thereof.

7. The abrasive article of claim 4, wherein the body comprises an abrasive surface area ratio (ASA1:ASA2) of at least 1.1:1 and not greater than 100:1.

8. The abrasive article of claim 1, wherein the inner annular region comprises a first group of abrasive segments defining a first distribution and the central region comprises a second group of abrasive segments defining a second distribution, wherein the first distribution is different than the second distribution.

9. The abrasive article of claim 8, wherein a spacing distance between the first group of abrasive segments is different than a spacing distance between a second group of abrasive segments.

10. The abrasive article of claim 1, wherein the abrasive segments define an abrasive annular region having an annular width defined as a distance between an inner annular circumference and an outer annular circumference along a radial axis, and wherein at least one abrasive segment extends for not greater than 95% of the annular width.

11. The abrasive article of claim 1, wherein the abrasive segments are coupled to the annular surface of the body and are arranged relative to each other to define a normalized maximum contact area variation (NMCAV) of not greater than 0.270 according to a contact area test.

12. The abrasive article of claim 8, wherein a spacing distance between the first group of abrasive segments is different than a spacing distance between a second group of abrasive segments.

13. The abrasive article of claim 8, wherein the spacing distance between the first group of abrasive segments is at least 0.01(aL1), wherein aL1 represents an average length of the abrasive segments of the first group.

14. The abrasive article of claim 8, wherein the spacing distance between the first group of abrasive segments is not greater than 100(aL1), wherein aL1 represents an average length of the abrasive segments of the first group.

15. The abrasive article of claim 8, wherein the spacing distance between the second group of abrasive segments is at least 0.01(aL2), wherein aL2 represents an average length of the abrasive segments of the second group or at least 0.1(aL2).

16. The abrasive article of claim 8, wherein the spacing distance between the second group of abrasive segments is not greater than 100(aL2).

17. The abrasive article of claim 1, wherein at least a portion of the abrasive segments comprise a longitudinal axis angled with respect to an associated radial axis.

18. The abrasive article of claim 8, wherein abrasive segments in the first group of abrasive segments define an alternating pattern with respect to the placement of the abrasive segments in an inner annular region and central annular region.

19. The abrasive article of claim 1, wherein the abrasive segments define an alternating pattern with respect to the placement of the abrasive segments in an outer annular region and central annular region.

* * * * *